US006871468B2

(12) United States Patent
Whitson

(10) Patent No.: US 6,871,468 B2
(45) Date of Patent: Mar. 29, 2005

(54) INTERLOCKING MASONRY WALL BLOCK

(75) Inventor: Robert L. Whitson, West Bend, WI (US)

(73) Assignee: Bend Industries, Inc., West Bend, WI (US)

( * ) Notice: Subject to any disclaimer, the term of this patent is extended or adjusted under 35 U.S.C. 154(b) by 93 days.

(21) Appl. No.: 09/940,562

(22) Filed: Aug. 28, 2001

(65) Prior Publication Data

US 2002/0023403 A1 Feb. 28, 2002

Related U.S. Application Data

(63) Continuation-in-part of application No. 09/928,125, filed on Aug. 10, 2001, now abandoned.
(60) Provisional application No. 60/228,517, filed on Aug. 28, 2000.

(51) Int. Cl.[7] ..... E04B 2/46
(52) U.S. Cl. ..... 52/592.6; 52/604; 52/603; 52/169.4
(58) Field of Search ..... 52/169.4, 583.1, 52/604, 603, 592.6; 405/284, 286

(56) References Cited

U.S. PATENT DOCUMENTS

| | | | | |
|---|---|---|---|---|
| 2,313,363 A | | 3/1943 | Schmitt | 61/39 |
| 4,565,043 A | | 1/1986 | Mazzarese | 52/593 |
| D299,067 S | | 12/1988 | Forsberg | D25/58 |
| 4,909,010 A | | 3/1990 | Gravier | 52/609 |
| 4,914,876 A | | 4/1990 | Forsberg | 52/169.4 |
| 5,017,049 A | | 5/1991 | Sievert | 405/284 |
| 5,064,313 A | | 11/1991 | Risi | 405/284 |
| 5,161,918 A | | 11/1992 | Hodel | |
| 5,294,216 A | | 3/1994 | Sievert | 405/286 |
| 5,490,363 A | | 2/1996 | Woolford | 52/604 |
| 5,505,034 A | | 4/1996 | Dueck | |
| 5,589,124 A | | 12/1996 | Woolford | 264/157 |
| 5,666,777 A | | 9/1997 | Murphy | 52/604 |
| 5,704,183 A | | 1/1998 | Woolford | 52/604 |
| 5,711,129 A | | 1/1998 | Woolford | 52/604 |
| 5,788,423 A | | 8/1998 | Perkins | 405/284 |
| 5,795,105 A | | 8/1998 | Guth | 405/284 |
| 5,827,015 A | | 10/1998 | Woolford | 405/286 |
| 5,941,042 A | | 8/1999 | Dueck | 52/604 |
| 5,951,210 A | * | 9/1999 | Maguire et al. | 405/286 |

(Continued)

FOREIGN PATENT DOCUMENTS

| | | | |
|---|---|---|---|
| CH | 663437 A5 | 12/1987 | E02D/17/20 |
| DE | 0 039 372 | 11/1981 | |
| FR | 2622227 | 4/1989 | E02D/29/02 |

OTHER PUBLICATIONS

Publication No:. US 2001/0019684 Sep. 2001 Manthei et al.*
Publication No.: US 2001/0004822 A1 Jun. 2001 Martin et al.*

*Primary Examiner*—Carl D. Friedman
*Assistant Examiner*—Nahid Amiri
(74) *Attorney, Agent, or Firm*—Ryan Kromholz & Manion, S.C.

(57) ABSTRACT

The present invention relates to an interlocking masonry wall block having two spaced lugs or projections and a cooperating recess or channel that enable like-shaped blocks to be stacked in a staggered relation to form straight and serpentine walls that are particularly suited for landscaping applications. In one embodiment, the lugs are located proximal the sides of the block and extend from an upper surface of the block. The channel is formed in a lower surface of the block. In another embodiment, the lugs are located at the rear corners of the block and extend below the lower surface of the block. The recess is formed in the rear end of the block between the lugs. Like-shaped blocks are stacked in a staggered relation so that each block is stacked atop two immediately lower blocks. In each embodiment, the lugs and their cooperating channel or recess define a setback dimension.

10 Claims, 24 Drawing Sheets

U.S. PATENT DOCUMENTS 6,082,933 A 7/2000 Maguire ..... 405/286
6,113,318 A 9/2000 Guth ..... 405/284
6,149,352 A 11/2000 MacDonald
6,183,168 B1 * 2/2001 Woolford et al. ..... 52/608
6,233,897 B1 * 5/2001 Jurik ..... 52/604
D467,009 S * 12/2002 Agee ..... D25/113
6,523,317 B1 * 2/2003 Bott et al. ..... 52/609

* cited by examiner

Fig. 27
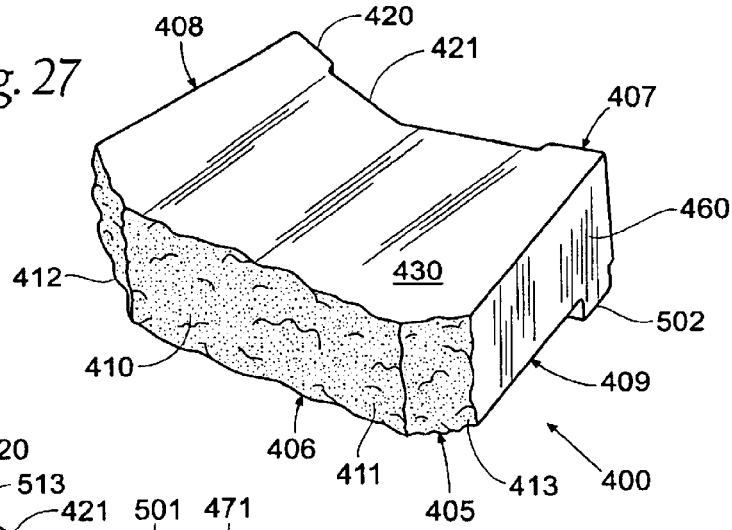
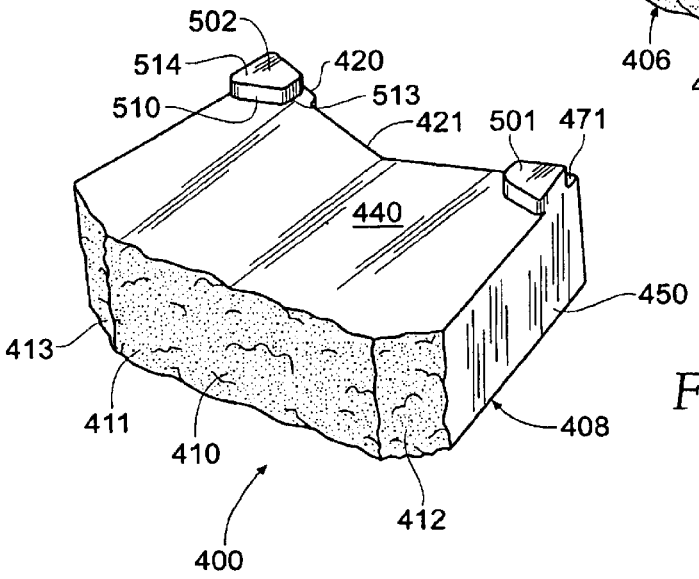
Fig. 28
Fig. 29
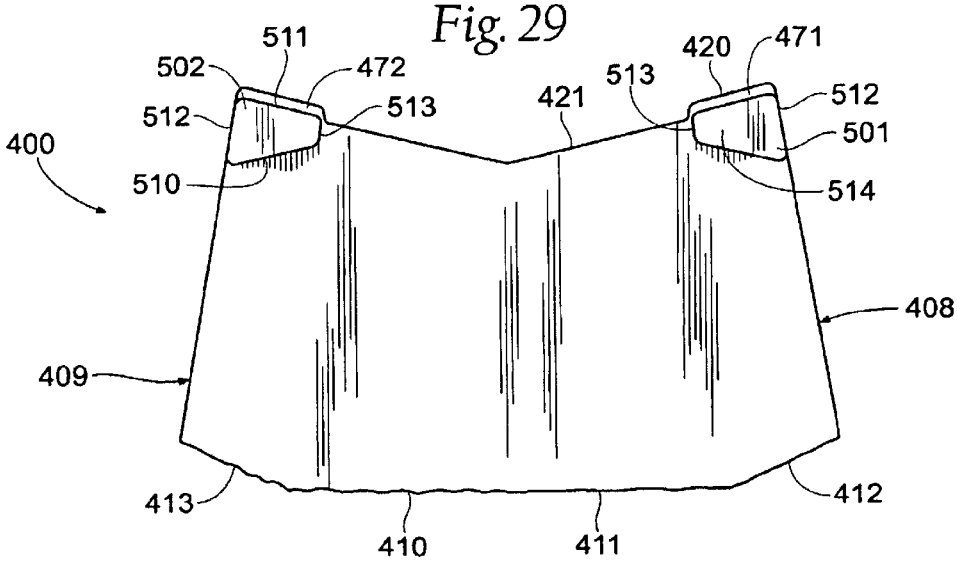

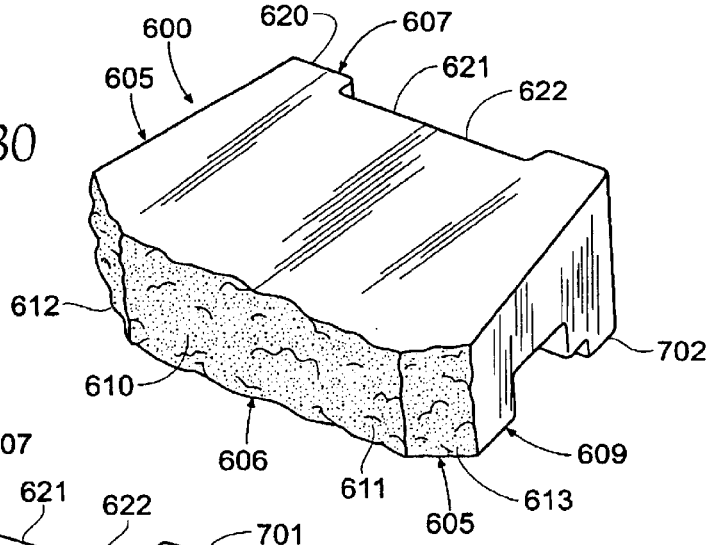
Fig. 30
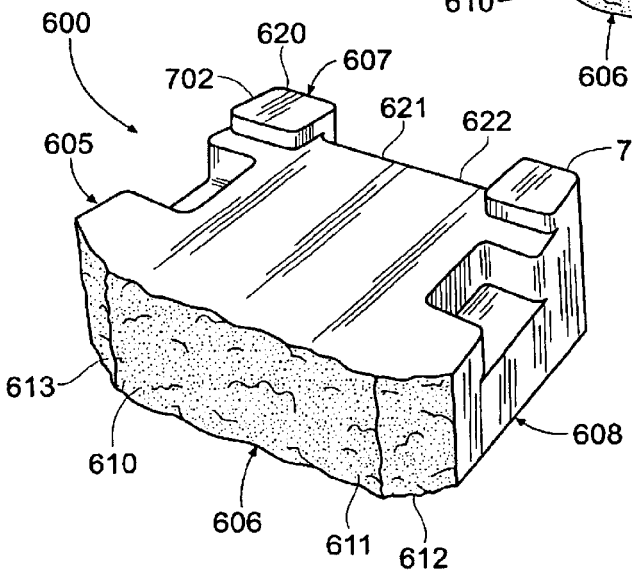
Fig. 31
Fig. 32
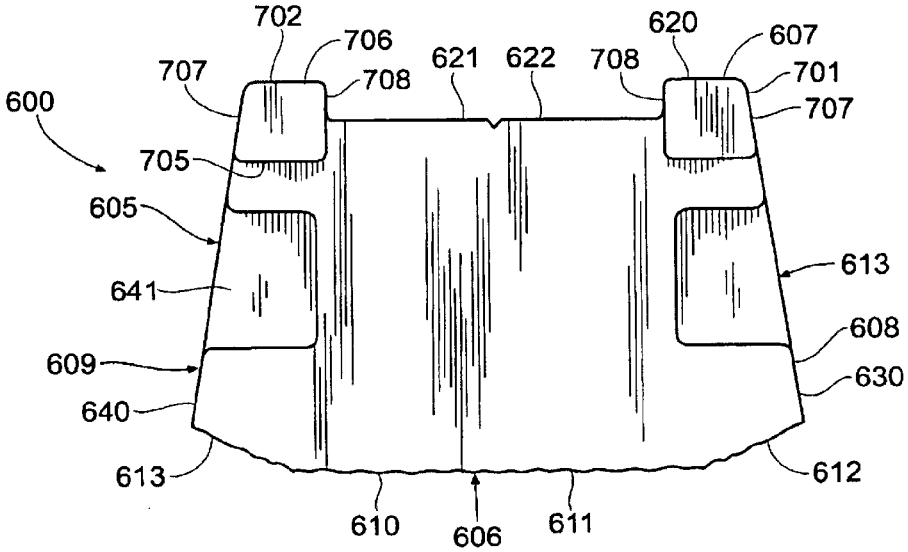

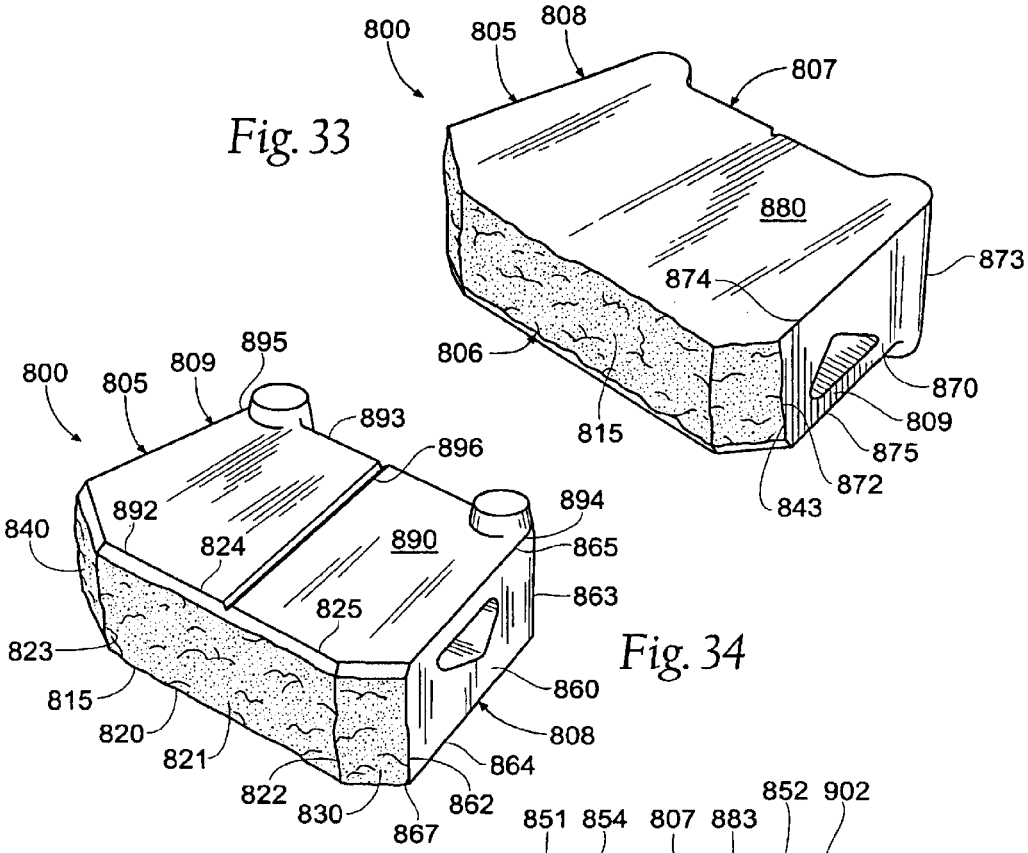
Fig. 33
Fig. 34
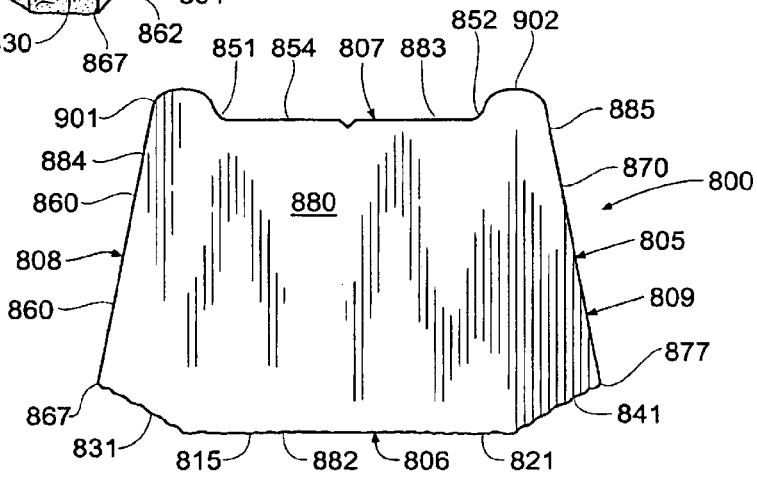
Fig. 35
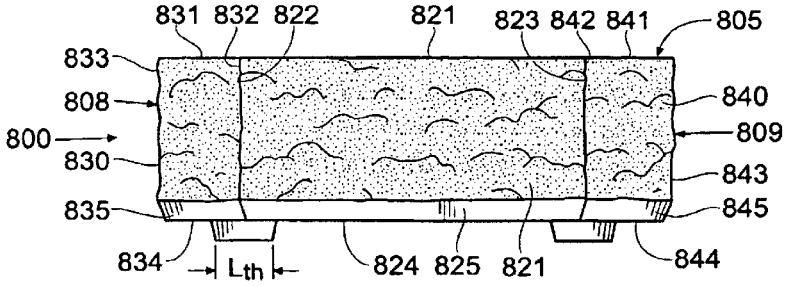
Fig. 36

INTERLOCKING MASONRY WALL BLOCK

BACKGROUND OF THE INVENTION

This application claims the benefit of provisional application Ser. No. 60/228,517 filed Aug. 28, 2000.

This application is continuation in part of co-pending U.S. Patent Application Ser. No. 09/928,125 filed on Aug. 10, 2001, now abandoned. This application also claims the benefit of provisional U.S. Application Ser. No. 60/228,517, filed Aug. 28, 2000.

TECHNICAL FIELD OF THE INVENTION

This invention relates to a masonry block for stacking on other like-shaped blocks in a staggered, interlocking and offset manner to form a gravity-type retaining wall that is particularly suited for integrating into a variety of landscape settings.

A variety of masonry block designs have been developed for building gravity-type retaining walls that depend on the weight of the blocks for their stability. Versatile block designs should take several factors into consideration. For walls three feet in height or less, the blocks should form a wall structure that can withstand the pressure of the earth behind the wall. The footprint of the block should be large enough to accommodate soils with relatively low bearing pressures so that the wall will not tilt or sink during use. The setback and height of the block should be such that the combined pressure of the earth and the weight of the wall fall within the footprint of the lowest course of blocks. The block design should also take into account the shape of the blocks, as well as the strength, density and durability of the material forming the block.

Retaining wall block designs require a mechanism for securing the blocks together to produce a stable wall structure. While the friction between the relatively rough surfaces of stacked blocks can help keep the wall together, this friction is not sufficient in many retaining wall applications. To increase stability, some blocks are designed to be mortared or otherwise adhered together to produce a rigid wall structure. Unfortunately, such retaining walls are prone to cracking due to settling, frost, water buildup behind the wall and earthquakes, as well as the normal use of the wall by people and animals that walk, stand, lean or sit on the wall.

Other retaining wall block designs incorporate fasteners such as rods, pins or keys to hold and clamp the blocks together. Examples of such block designs are shown in U.S. Pat. Nos. 4,914,876 to Forsberg, 3,390,502 to Carroll, and 4,909,010 to Gravier, the disclosures of which are incorporated by reference herein. A significant problem with these block designs is the expense of the extra components and increased installation costs. These designs can also suffer from unsightly cracks that tend to form in these types of walls.

Interlocking wall block designs have been developed to overcome the problems associated with the blocks that form rigid retaining wall structures. Interlocking block designs typically have one or more integral projections extending from the upper or lower surface of the block. When stacked, the projection of one block abuts against a surface of another block to help hold the blocks together. The projections also provide a mechanism for offsetting stacked blocks. This offset or setback helps produce a more stable retaining wall that leans into the earth or hill behind the wall to resist the pressure exerted by the earth or hill on the wall. Individual blocks do not need to be rigidly secured by mortar, adhesive, rods, pins or keys, so that the wall is free to flex and accommodate movements in the wall caused by settling, frost, water buildup, earthquakes and normal use. Blocks for retaining walls of this type are described in U.S. Pat. Nos. 5,827,015 to Woolford, 2,313,363 to Schmitt, and 4,565,043 to Mazzarese, the disclosures of which are incorporated by reference herein.

One problem with conventional interlocking masonry wall blocks is that the thickness of the integral projection is directly related to the amount of setback desired for each course of blocks. A retaining wall application requiring a half-inch setback per course requires blocks with half-inch thick projections. Yet, thin projections are structurally weak and prone to chipping and cracking. While the height of the block can be increased to increase the thickness of its setback, this results in a heavier block that is more difficult to handle. In addition, tall blocks also do not lend themselves to landscaping gradually sloping terrain. Large portions of the block stick out above ground level before a step down at the end of a row or course of blocks can occur. This produces an unsightly wall and results in a waste of material.

Another problem with conventional interlocking masonry wall blocks is that the integral projection is located along the rear or front edge of the block. As noted above, the setback projection is frequently only a half-inch thick when the blocks are sized for easy handling. Yet, these relatively thin and weak projections are located where they are easily damaged if dropped, improperly stacked or otherwise mishandled. In addition, rear projections are in direct contact with the wetness and acidity of the earth during use, which can cause the projection to deteriorate, weaken and fail over time. Front projections extend upwardly and can collect water between them and the upper course of blocks, which can freeze and crack the projection.

A further problem with conventional interlocking masonry wall blocks is that the integral projections are relatively short in height to reduce the possibility of chipping and cracking. Although the short projections may be less likely to crack, they do not provide a sufficiently tall abutment to easily and consistently align the block over a lower course of blocks. During construction of a wall, workers have a tendency to leave a gap between the projection and the lower course of blocks or allow the projection to ride-up onto the upper surface of the lower block. These misalignments are not easily detected given the thinness of the projection and its relatively small height. This is especially so for blocks with rear projections that extend down from the lower surface of the block, because the workers are not able to easily see that the blocks are properly aligned. Misalignments can be even more difficult to notice in construction settings where dirt, gravel and other debris are present, and may compact against the setback projection or get on the upper or lower surfaces of the blocks.

A still further problem with conventional interlocking masonry wall blocks is that they have limited ability to produce serpentine walls with straight, concave and convex portions. The integral projections are sized and shaped to fit into grooves of lower blocks so that the stacked blocks must be oriented a particular way. If a curve is possible, the radius of the curve is constant, so that a true serpentine wall with curves that gradually increase or decrease in radius are not possible. These limitations of conventional block designs prevent the wall from being integrated into the natural contours of the landscape and thus impede the aesthetic value of the wall.

A still further problem with conventional interlocking masonry wall blocks is that the integral projections do not ensure an even amount of setback for straight and curved portions of the wall. For example, a block with a flange along its front or rear edge produces a wall with discontinuities in the amount of setback between adjacent block as shown in FIG. 14. In addition, the pitch of the wall is also greater in both the concave and convex curved portions of the wall than in the straight portions as shown in FIGS. 14 and 16. This increasing setback and pitch occurs even though a retaining wall may need to be stronger and require more setback in straight portions of the wall than in curved portions.

A still further problem with conventional interlocking masonry wall blocks is that the blocks require a fixed amount of lateral offset to the right or left of the lower blocks on which they rest. Yet, obstructions at the location where the wall is to be built or the addition of drain pipes in the wall do not always permit each block to be offset a constant amount throughout the entire wall. A block in one course may need to be laterally offset two or three inches to the right or left from the blocks beneath it, and another block in the same or a different course may need to be laterally offset four or five inches from the blocks beneath it. Yet, many interlocking block designs do not allow sufficient flexibility to offset the blocks as needed to accommodate various obstacles or drain pipes. This inflexibility can complicate construction or renders the block unusable for some retaining wall applications.

A still further problem with conventional interlocking masonry wall blocks is that the integral projection does not provide sufficient resistance to lateral side-to-side movement of the block. Side-to-side movement is only resisted by adjacent blocks in the same course or tier. The side walls of these adjacent blocks abut each other to prevent side-to-side movement. However, should one block in a given course shift or move out of abutting alignment with one of its adjacent blocks, then each of the blocks in that row would be susceptible to shifting as well. Moreover, the blocks that form an end of the wall are not restrained from lateral movement away from its sole adjacent block and could be knocked off the wall altogether.

A still further problem with conventional interlocking masonry wall blocks is that several different block shapes must be combined to form the straight and curved sections of a serpentine wall. The need for multiple block designs result in increased manufacturing, inventory, shipping and construction costs. The multiple block designs also result in more complicated serpentine wall designs that are not easily integrated to the shape of a specific and unique landscape setting.

A still further problem with conventional interlocking masonry wall blocks is that they are heavy and difficult to handle. The blocks are typically solid throughout. The openings tend to be small and do not significantly reduce the weight of the block. The excessive weight is compounded by the fact that the block must be tall enough to provide a setback projection or flange that is sufficiently thick to withstand cracking and chipping during transport, construction and use.

The present invention is intended to solve these and other problems.

BRIEF DESCRIPTION OF THE INVENTION

The present invention relates to an interlocking masonry wall block having two spaced lugs or projections and a cooperating recess or channel that enable like-shaped blocks to be stacked in a staggered relation to form straight and serpentine walls that are particularly suited for landscaping applications. In one embodiment, the lugs are located proximal the sides of the block and extend from an upper surface of the block. The channel is formed in a lower surface of the block. In another embodiment, the lugs are located at the rear corners of the block and extend below the lower surface of the block. The recess is formed in the rear end of the block between the lugs. Like-shaped blocks are stacked in a staggered relation so that each block is stacked atop two immediately lower blocks. In each embodiment, the lugs and their cooperating channel or recess define a setback dimension.

One advantage of the present interlocking masonry wall block is that the thickness of the integral projections is not related to the desired amount of setback for each course of blocks. A retaining wall application requiring a half-inch setback per course can have projections that are one or two inches thick. These thicker projections are more structurally sound and not prone to chipping and cracking. The block can be relatively short in height to produce a block that is light weight and easy to handle.

Another advantage of the present interlocking masonry wall block is that the block can be kept relatively short so that it can be more easily integrated into gradually sloping terrain. The smaller height allows more frequent steps to be incorporated into a particular wall design so the blocks do not rise up above ground level a great deal. This produces a more aesthetically pleasing wall that fits and blends into the natural terrain. The blocks also make more efficient use of material.

A further advantage of the present interlocking masonry wall block is that the integral projections are robustly designed or located away from the front and rear edges of the block. The rear lugs are robustly and smoothly designed to withstand normal abuse during shipping and construction of a wall. The projections located intermediate the front and rear ends of the block are less likely to be damaged if the block is dropped or bumped during transport. These intermediate projections are also protected by the lower blocks during use so that they are not exposed to the earth and air. This keeps the projections dry and away from the acidity of the earth, which improves the life expectancy of the block and retaining wall formed by the blocks.

A still further advantage of the present interlocking masonry wall block is that the integral projections are relatively thick and relatively tall. As stated above, the projections can be relatively thick or long because they are not dependent on the desired setback. This increased thickness enables the projections to have an increased height without compromising their structural strength. The projections provide a sufficiently tall abutment to easily and consistently align the block over the lower course of blocks. This reduces the amount of misaligned blocks, and improves the strength and aesthetic uniformity of the retaining wall.

A still further advantage of the present interlocking masonry wall block is that they produce serpentine walls with varying convex and concave shaped portions. The size and shape of the open cores allow the smaller, spaced projections to fit into the open cores of the blocks of the lower course. Adjacent blocks can be oriented to form a continuous wall with curves and straight portions that gradually increase or decrease in radius.

A still further advantage of the present interlocking masonry wall block is that the integral projections produce a relatively uniform amount of setback for straight and curved portions of the wall. Even though the setback increases slightly in concave curved portions of the wall and decreases slightly in convex portions of the wall, this change in setback occurs evenly and gradually as the radius of the curve increases. Discontinuities between adjacent blocks are avoided. In addition, the pitch of the wall is relatively constant for straight and curved portions of the wall. The wall leans back a slightly increased amount in concave portion and less in convex portions so that a relatively constant pitch is achieved throughout the entire serpentine wall. This uniform setback and relatively constant pitch enables more courses of blocks to be used in many serpentine walls, and helps produce a more stable serpentine wall where the combined weight of the wall and earth pressure remain within the footprint of the block.

A still further advantage of the present interlocking masonry wall block is that the integral projections allow the blocks forming one course to have a varying amount of lateral offset with relation to the course of blocks upon which they are stacked. The retaining wall can more easily avoid obstructions, such as a sump pump discharge pipe. The block can also be arranged to allow drain pipes to pass through the middle of the wall. This flexibility also allows one course of blocks to be laterally offset to accommodate the ledge or sill of a building. Thus, the present block facilitates the construction process and the ability to use the block in a wide variety of locations.

A still further advantage of the present interlocking masonry wall block is that the integral projections provide additional resistance to lateral side-to-side movement of the block. The blocks can easily be stacked so that the outer wall of one of the lugs engages the inside wall of one of the lugs of a block upon which it lays. Accordingly, side-to-side movement is resisted not only by the adjacent blocks in the same course or tier, but by the blocks above and below it as well. Should one block in a given course shift or move out of abutting alignment with one of its adjacent blocks, then the remaining blocks in that row would still be held in place by the blocks above or below it. The projections are particularly helpful in holding the end blocks of the wall in place where the block would otherwise be free to slide laterally and out of place, or off the wall altogether.

A still further advantage of the present interlocking masonry wall block is that an entire serpentine wall can be built from a plurality of like-shaped blocks. The need for only a single block design results in reduced manufacturing, inventory, shipping and construction costs. The single block design also makes it easier to design a serpentine wall that is integrated to the shape of a specific and unique landscape setting.

A still further advantage of the present interlocking masonry wall block is its reduced weight. The open core and hand hold designs reduce the weight of the block so that they are easier to handle during manufacture, shipping and construction. The open core and hand hold designs also reduces material costs, which can be passed on to the consumer.

Other aspects and advantages of the invention will become apparent upon making reference to the specification, claims and drawings.

BRIEF DESCRIPTION OF THE DRAWINGS

FIG. 27 is a raised, front perspective view of the third embodiment of the interlocking masonry wall block.

FIG. 28 is a lowered, front perspective view of the third embodiment of the interlocking masonry wall block showing its feet.

FIG. 29 is a bottom view of the third embodiment of the interlocking masonry wall block.

FIG. 30 is an elevated, front perspective view of the fourth embodiment of the interlocking masonry wall block.

FIG. 31 is a lowered, front perspective view of the fourth embodiment of the interlocking masonry wall block showing its feet.

FIG. 32 is a bottom view of the fourth embodiment of the interlocking masonry wall block showing its feet and recess.

FIG. 33 is a raised, front perspective view of the fifth embodiment of the interlocking masonry wall block showing the trapezoidal shape of the upper surface.

FIG. 34 is a lowered, front perspective view of the fifth embodiment of the interlocking masonry wall block showing the lugs.

FIG. 35 is a top view of the fifth embodiment of the interlocking masonry wall block showing the trapezoidal shape of the upper surface.

FIG. 36 is a front view of the fifth embodiment of the interlocking masonry wall block showing the multi-faceted front surface, and showing the lugs in spaced relation with each other.

DESCRIPTION OF THE PREFERRED EMBODIMENT

While this invention is susceptible of embodiments in many different forms, the drawings show and the specification describes in detail several preferred embodiments of the invention. It should be understood that the drawings and specification are to be considered an exemplification of the principles of these inventions. They are not intended to limit the broad aspects of the inventive block designs to the embodiments illustrated.

Figure 1:
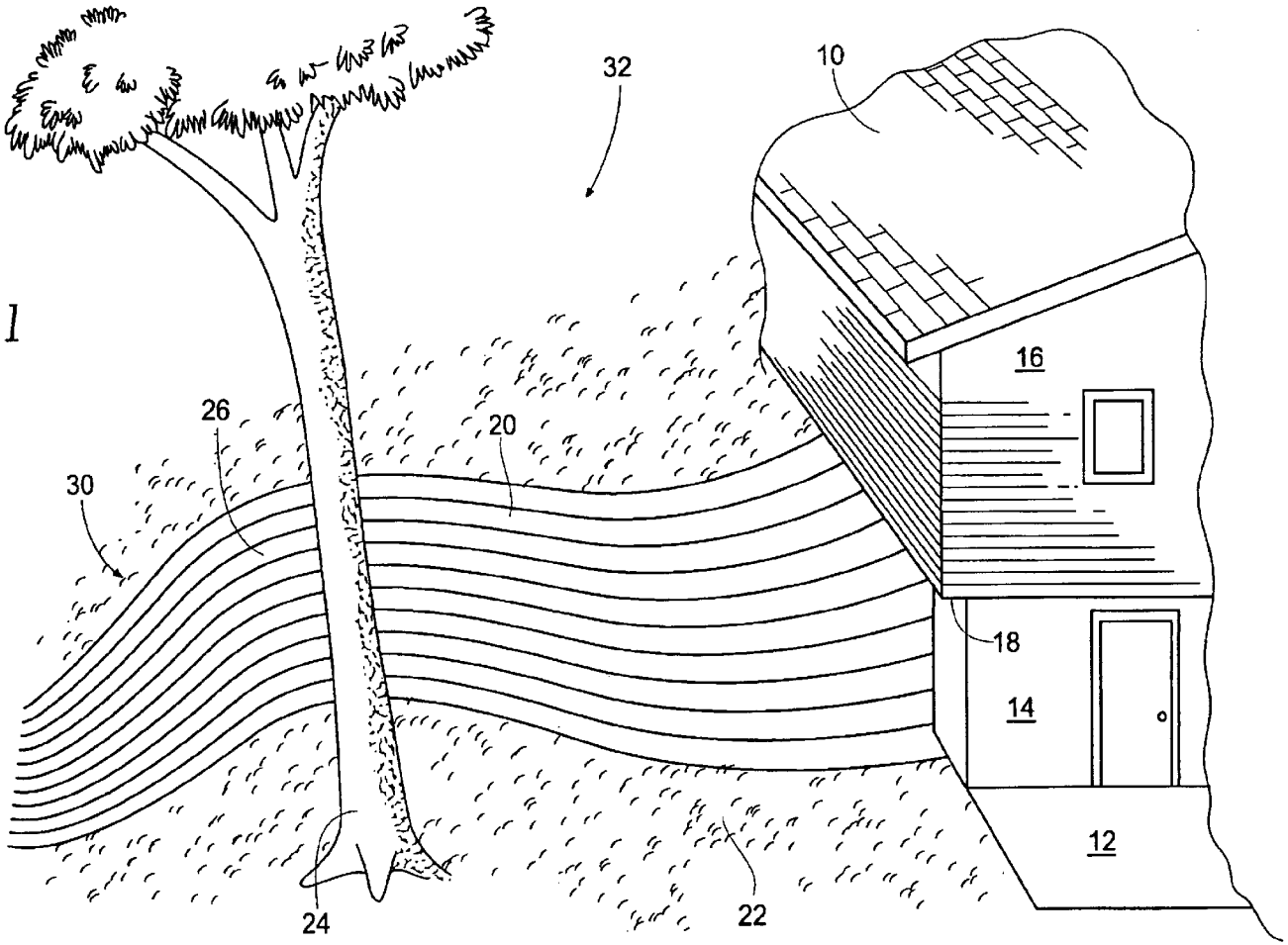
FIG. 1 is an elevated view of a house built to a unique landscape setting with a gradually sloping and contoured hill that feeds down to the level of the backyard patio of the house and a pre-existing tree.

FIG. 1 shows a house 10 with a walkout basement leading to a patio 12 constructed in the backyard of the house. The house 10 has a concrete foundation 14 which transitions to brick 16 along a sill 18 at the top of the foundation. The house is constructed into a hill 20 that levels off to a particular ground level 22 in the backyard of the house. The hill 20 and its terrain 30 and natural plant life 24 form a unique landscape setting 32 around the house 10.

Figure 2:
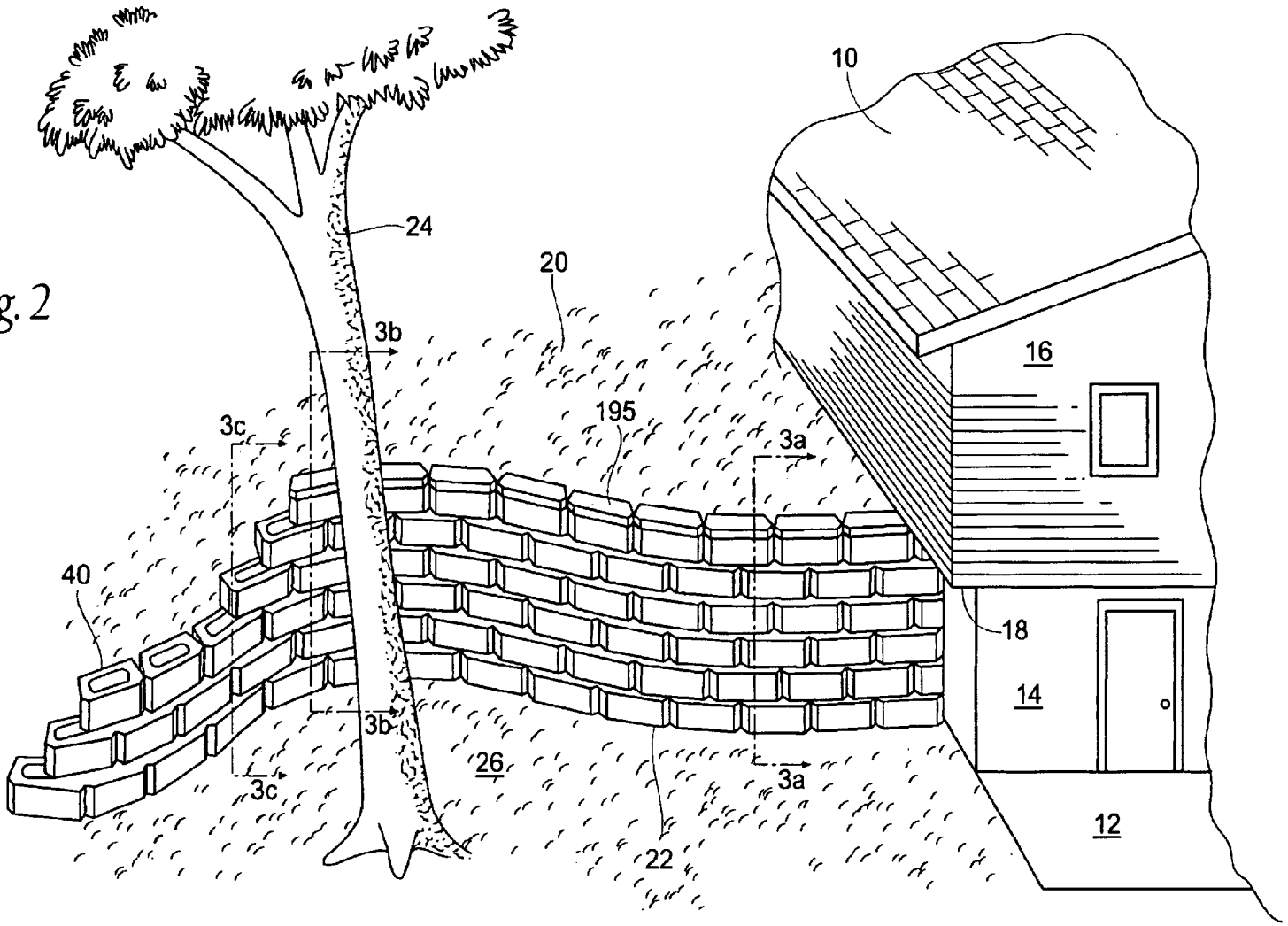
FIG. 2 is an elevated view showing a three foot high serpentine retaining wall constructed from a plurality of the present like-shaped, interlocking masonry wall blocks, and integrated into the natural contours of the hill and unique landscape setting of the house.
Figure 3A:
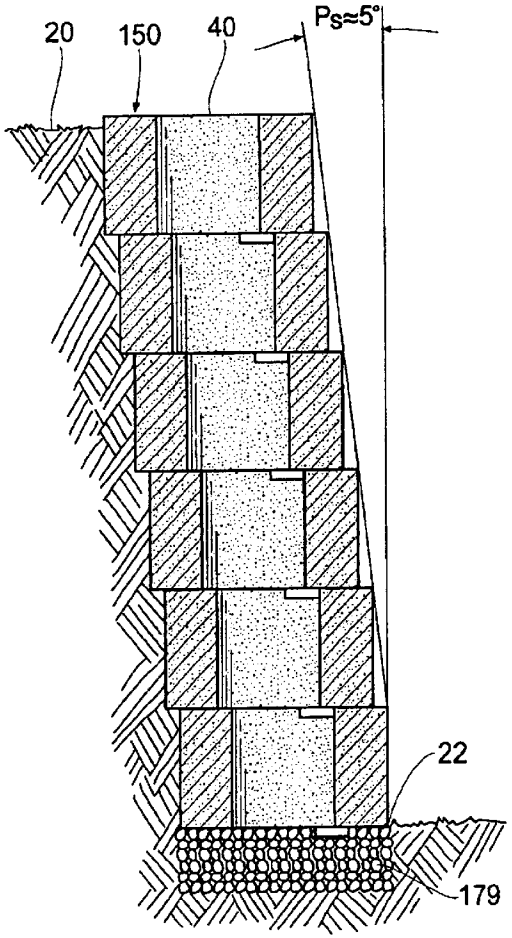
FIG. 3*a* is a cross sectional view of FIG. 2 taken along line 3*a*—3*a* showing a straight wall section having a pitch of about Ps=5°.
Figure 3B:
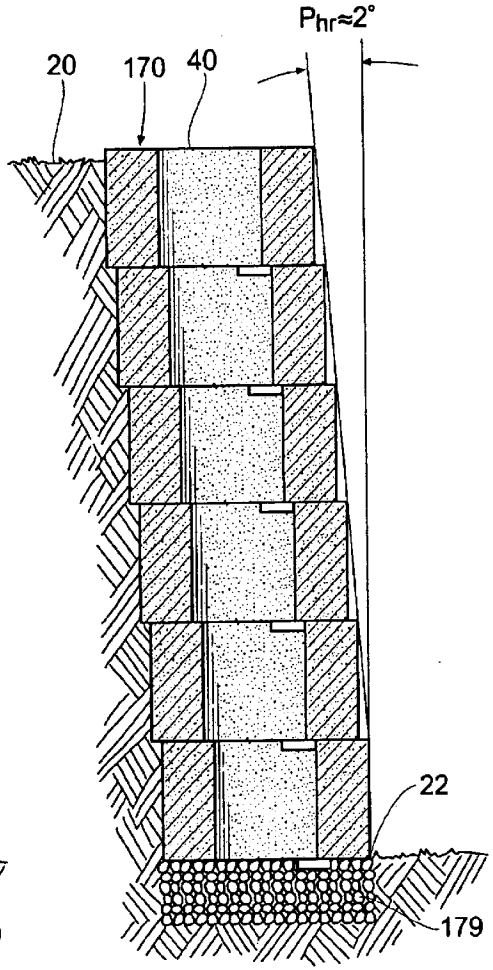
FIG. 3*b* is a cross sectional view of FIG. 2 taken along line 3*b*—3*b* showing a high radius, convex curved portion of the wall having a pitch of about Phr=2°.
Figure 3C:
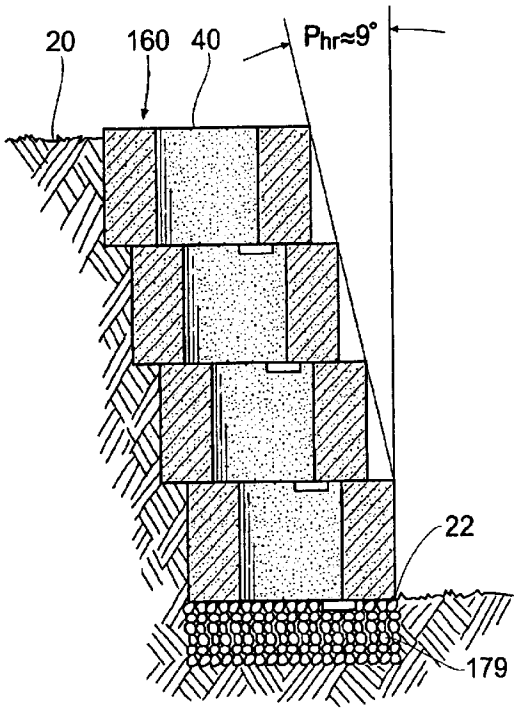
FIG. 3*c* is a cross sectional view of FIG. 2 taken along line 3*c*—3*c* showing a high radius, concave curved portion of the wall having a pitch of about Phr=9°.

FIGS. 2–16 pertain to a first interlocking masonry block design that is generally referred to by reference number 40. As with each of the block designs discussed below, the block 40 can be used for constructing serpentine retaining walls with straight and curved portions, such as the landscape retaining wall 140 shown in FIG. 2. The serpentine wall 140 is easily integrated into a variety of landscape settings 32. The like-shaped blocks 40 have a setback, as discussed below. A degree of setback is maintained throughout the entire serpentine wall 140. As discussed below, the setback impacts the degree the wall is pitched or leans into the hill 20. As shown in FIGS. 3*a*, 3*b* and 3*c*, the amount of pitch (P) in the wall 140 is somewhat less in convex curved portions of the wall and somewhat greater in concave portions of the wall relative to the pitch in straight portions of the wall.

An individual block 40 in accordance with the first embodiment of the present invention is shown in FIGS. 4–9. The block 40 has a main body 42 with upper 44 and lower 45 surfaces. The upper 44 and lower 45 surfaces are generally parallel to each other. When laid in place on a horizontal supporting surface, the upper 44 and lower 45 surfaces are horizontal as well. The main body 42 includes a front wall 51, a rear wall 52, and opposed side walls 53 and 54. Each wall 51–54 is integrally formed to its two adjacent walls during the molding process. Each wall 51–54 has an inside 61 and an outside 62 surface. Each wall has a wall width of roughly two (2) inches between its inside 61 and outside 62 surfaces. The upper 44 and lower 45 surfaces of each wall 51–54 have a relatively smooth masonry finish. The walls 51–54 are solid and form continuous surfaces 44, 45, 61 and 62. The outer surface 62 of the front wall 51 is roughened to give it a natural cut or chipped stone finish. A conventional masonry material for landscape retaining wall blocks is used to form the block 40. A single block 40 weighs about twelve pounds.

Figures 4, 5, 6, 7:
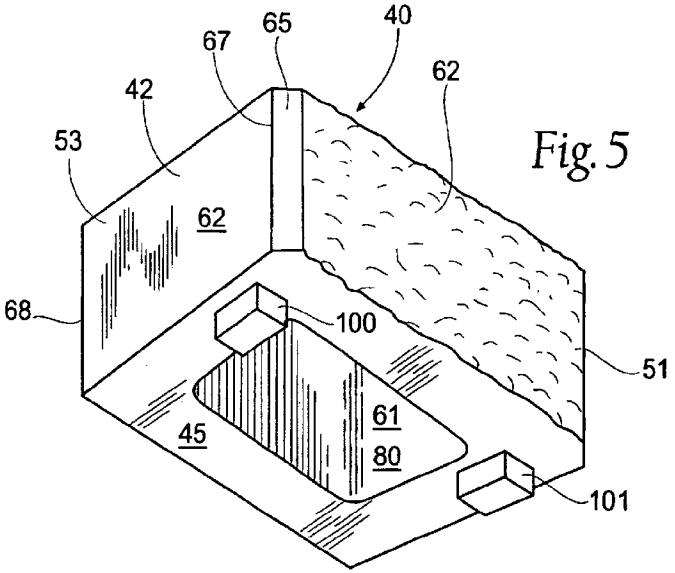
FIG. 4 is an elevated, front perspective view of the first embodiment of the interlocking masonry wall block showing the trapezoidal shape of the upper surface and open core of the block.
FIG. 5 is a lowered, front perspective view of the first embodiment of the interlocking masonry wall block showing the trapezoidal shape of the lower surface, the open core of the block, and its rectangular shaped integral projections.
FIG. 6 is a front view of the first embodiment of the interlocking masonry wall block.
FIG. 7 is a top view of the first embodiment of interlocking masonry wall block.
Figure 8:
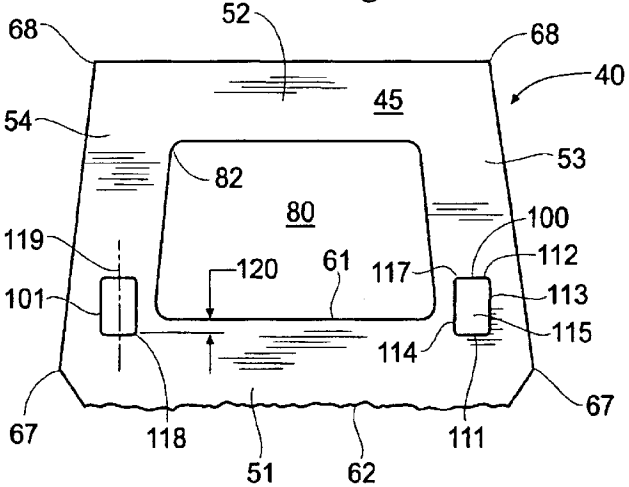
FIG. 8 is a bottom view of the first embodiment interlocking masonry wall block showing the orientation of the offset projections relative to the inside surface of the front wall of the block.
Figure 9:
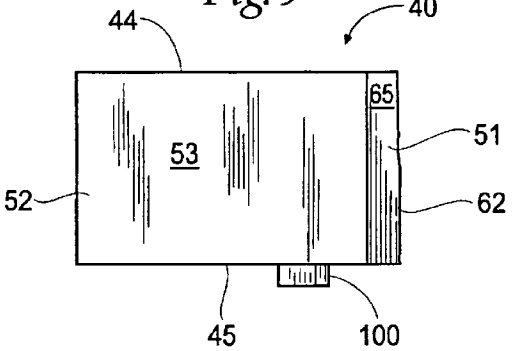
FIG. 9 is a side view of the first embodiment of the interlocking masonry wall block.

The block 40 has a generally trapezoidal shape as best shown in FIGS. 7 and 8. The inside 61 and outside 62 surfaces of the front 51 and rear 52 walls are parallel, and perpendicular to the upper 44 and lower 45 surfaces. The inside 61 and outside 62 surfaces of the side walls 53 and 54 are also perpendicular or vertical to the upper 44 and lower 45 surfaces. The block 40 has a height of about four (4) inches and a depth of about eight (8) inches. The width of the block at its front wall 51 is roughly twelve (12) inches from the outer surface 62 of each side wall 53 and 54. The width of the block at its rear wall 52 is roughly ten (10) inches from the outer surface of each side wall 53 and 54. Each side wall 53 and 54, and its respective inside and outside surfaces 61 and 62, converge toward the other at an angle of about seven degrees (7°) as it extends toward the back wall 52. The outside surface 62 of the front wall 51 has beveled ends 65. The surface of these ends 65 angle back toward the rear of the block. The outside surface 62 of the angled ends 65 meet the outside surface of the side walls 53 or 54 along edges 67. The outside surface 62 of the rear wall 52 meets the outside surface of the side walls 53 or 54 along edges 68.

The block 40 has an open core or interior 80 that extends completely through the block from its upper surface 44 to its lower surface 45. The open core 80 is defined by the inside surfaces 61 of the front, rear and side walls 51–54. The open core 80 has a generally trapezoidal shape that is smaller in size and similar to the trapezoidal shape formed by the outer surface 62 or perimeter of the block 40. The open core 80 has a width at its front of about seven and a half (7½) inches, and a width at its rear of about six and a half (6½) inches. The open core 80 is about four (4) inches deep taken along a line perpendicular to the inside surfaces 61 of the front and rear walls 51 and 52. The corners 82 of the open core 80 are rounded to a radius of roughly three-quarters (¾) of an inch. One of ordinary skill in the art should readily appreciate that the volume of the core can vary, but is preferably maximized to decrease the weight and material cost of the block without impairing the strength, integrity and manufacturability of the block. Similarly, the actual shape and dimensions of the core 80 can vary, provided the core maintains its ability to receive the lug-shaped projections of another block 40, as discussed below. The open core 80 should not contain any obstruction that would interfere with the desired ability to receive these lugs.

Two integral lug-shaped projections 100 and 101 extend from the lower surface 45 of the block 40. The projections 100 and 101 have front 111, rear 112 and opposed side 113 and 114 surfaces. These surfaces are generally flat and perpendicular to the lower surface 45 of the block and parallel to the inside and outside surfaces 61 and 62 of the walls 51–54, respectively. Each lug 100 and 101 has a bottom surface 115 that is generally parallel to the lower surface 45 of the block 40. Each lug 100 and 101 has a width of about one (1) inch from side 113 to side 114, and a length or thickness of about one and a half (1½) inches from front 111 to rear 112. Each lug 100 and 101 has a height of about five-eighths (⅝) of an inch, and its corners and vertical edges 117 are rounded to a radius of about seven-sixteenths (7/16) of an inch. One of ordinary skill in the art should readily appreciate that the size and shape of the lugs 100 and 101 can vary provided they maintain their strength, integrity and manufacturability.

Each projection 100 and 101 is generally centered between the inside 61 and outside 62 surfaces of its respective side wall 53 or 54. Each projection 100 and 101 has a portion 118 positioned forward or in front of the inside surface 62 of the front wall 51. This portion 118 provides an amount of setback 120 for the block 40. The perpendicular distance between the front surface 111 of each projection 100 and 101 and the inside surface 62 of front wall 51 is the setback dimension 120. In this embodiment, the setback dimension 120 is shown to be about one-quarter (¼) of an inch. The setback 120 is the same for both projections 100 and 101. However, it should be understood that the setback dimension 120 could be larger or smaller without departing from the broad aspect of this present wall block invention. Each projection 100 and 101 has a centerline 119. This centerline 119 is shown perpendicular to the inside and outside surfaces 61 and 62 of the front wall 51, but could be parallel to the inside and outside surfaces of its respective side wall 53 or 54.

The like-shaped blocks 40 are structured to be laterally aligned in an abutting side-by-side engagement, and vertically aligned in a staggered, stacked manner so that one block rests atop two other blocks. When arranged in this manner, the blocks 40 form a multi-tiered wall 140, such as the wall shown in FIG. 2. The wall 140 is typically constructed one course at a time. Once a lower course 141 is set in place, an upper course 142 is placed on top of it. The blocks 40 can be arranged to form walls 140 having straight wall portions 150 as in FIG. 10, concave curved wall portions 160 as in FIG. 11, and convex curved wall portions 170 as in FIG. 12. The concave portions 160 have a degree of curvature that ranges from a low radius curve 161, to a medium radius curve 162, to a high radius curve 163. Similarly, the convex portions 170 range from low 171, to medium 172, to high 173 radius curves. The blocks 40 can be arranged to gradually or rapidly increase or decrease the radius of the curvature of the concave or convex curves 160 or 170, which enables the wall 140 to conform to the unique landscape setting 30.

Figure 11:
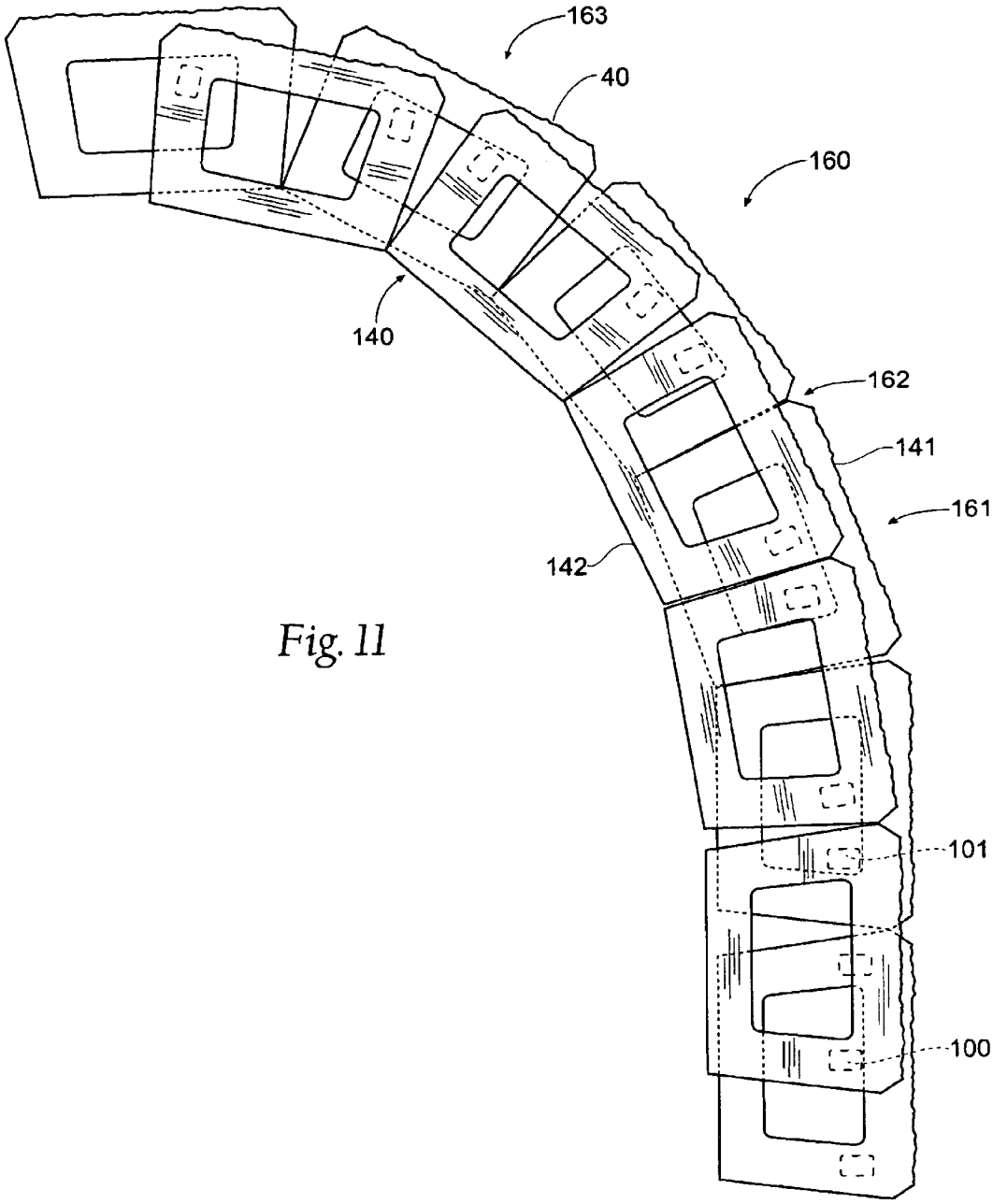
FIG. 11 is a top view of two courses of the first embodiment of the present like-shaped interlocking blocks arranged in a concave curve configuration that gradually increases from a low radius curve, through a medium radius curve, to a high radius curve.
Figure 12:
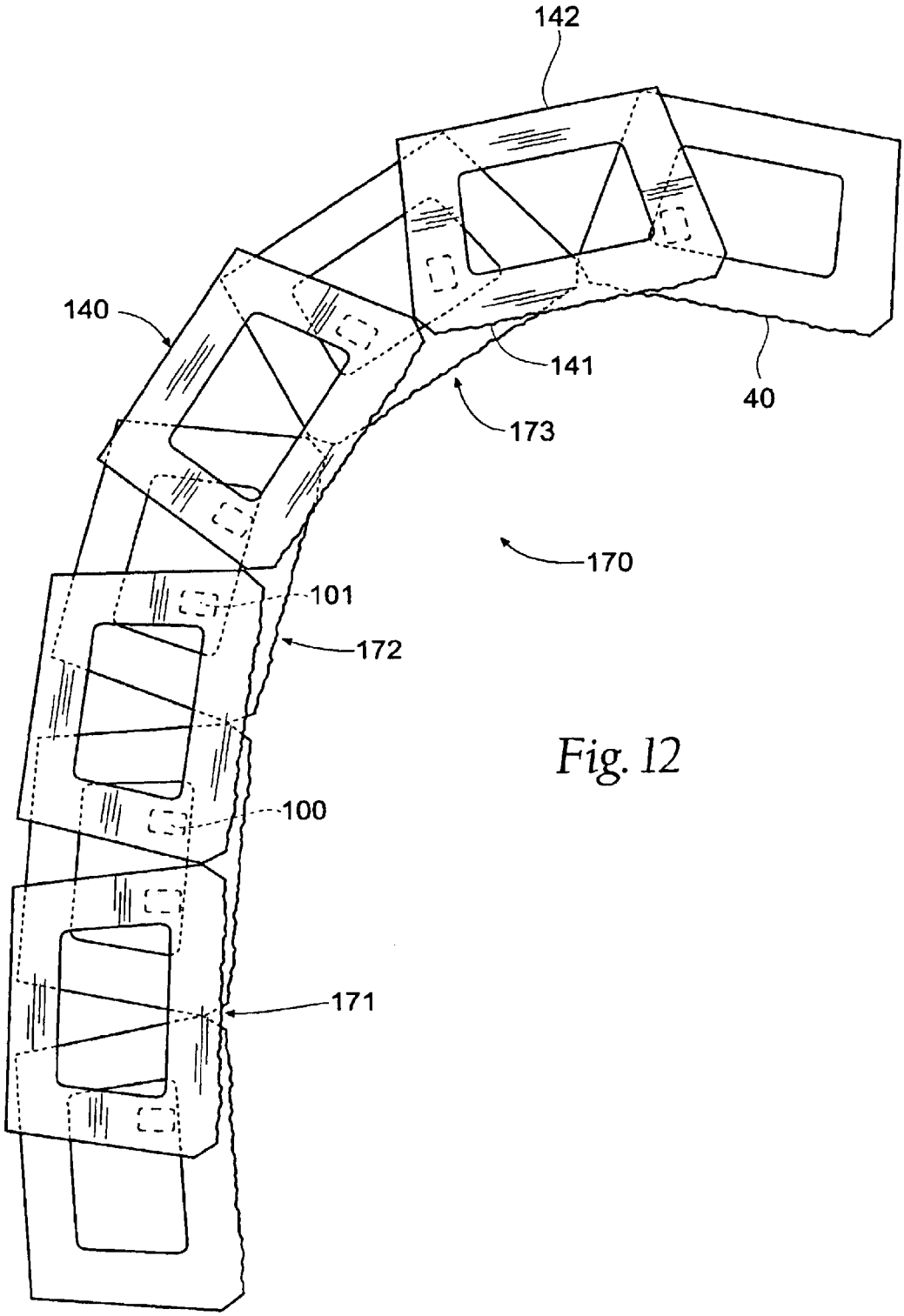
FIG. 12 is a top view of two courses of the first embodiment of the present like-shaped interlocking blocks arranged in a convex curve configuration that gradually increases from a low radius curve, through a medium radius curve, to a high radius curve.
Figure 13:
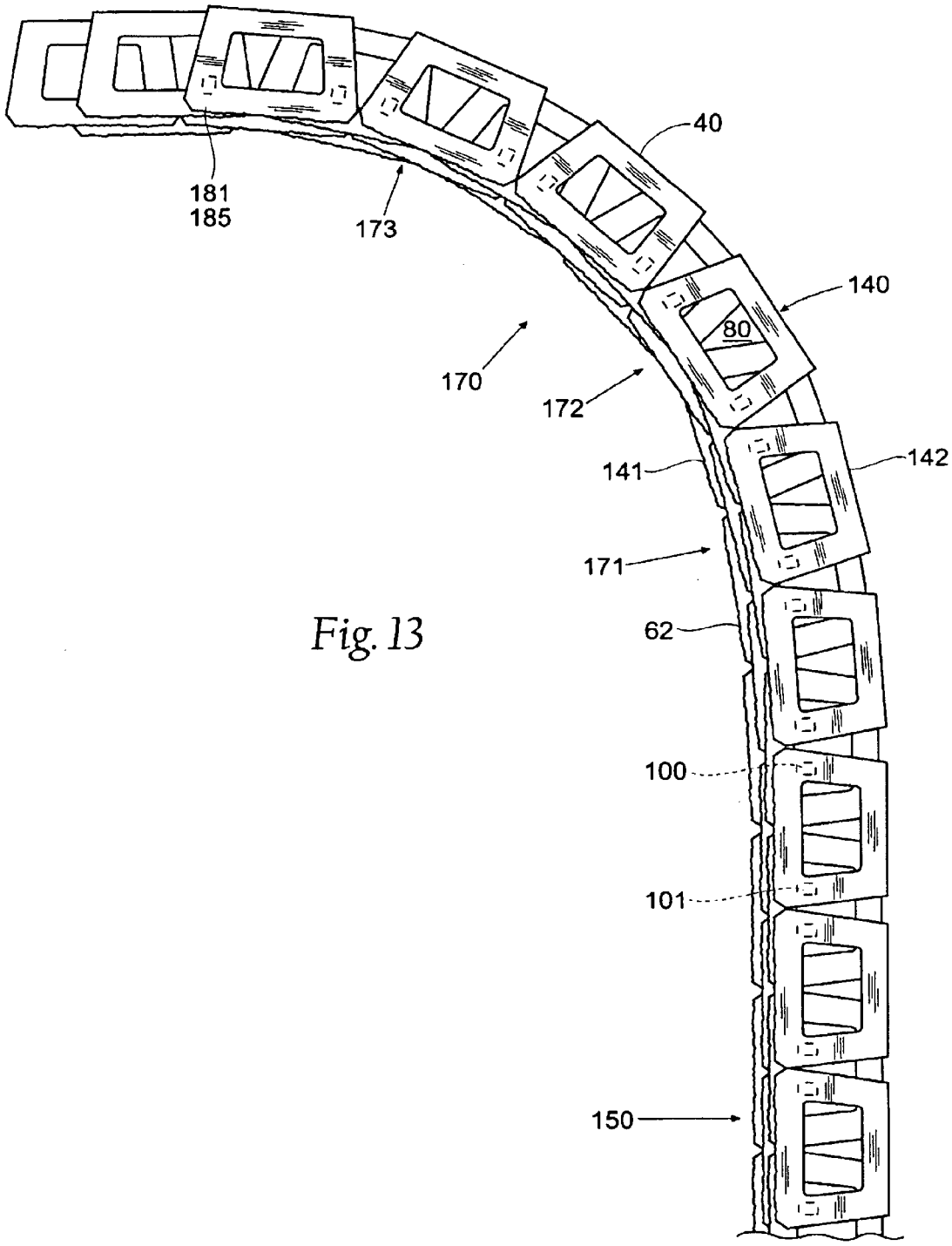
FIG. 13 is a top view of a convex shaped retaining wall formed by the first embodiment of the present like-shaped, interlocking masonry wall blocks, with a pitch of Ps=1 in the straight section, and about Pmr=0.7 in the medium radius section, and about Phr=0.4 in the high radius section.
Figure 14:
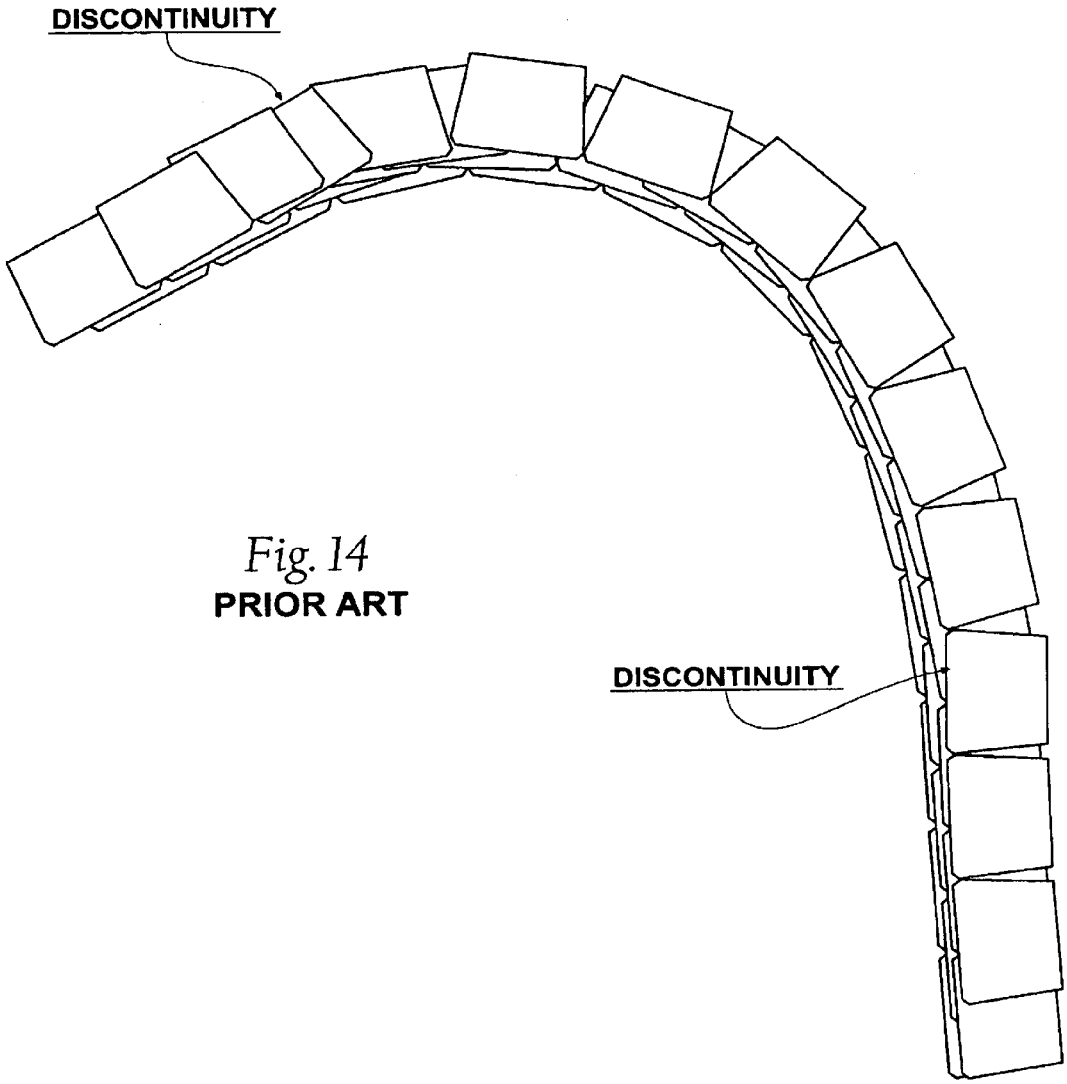
Fig. 14 PRIOR ART
FIG. 14 is a top view of a convex shaped retaining wall formed by a conventional rear flange, interlocking masonry wall blocks, with a pitch of Ps=1 in the straight section, and about Pmr=1.2 in the medium radius section, and about Phr=1.3 in the high radius section.
Figure 15:
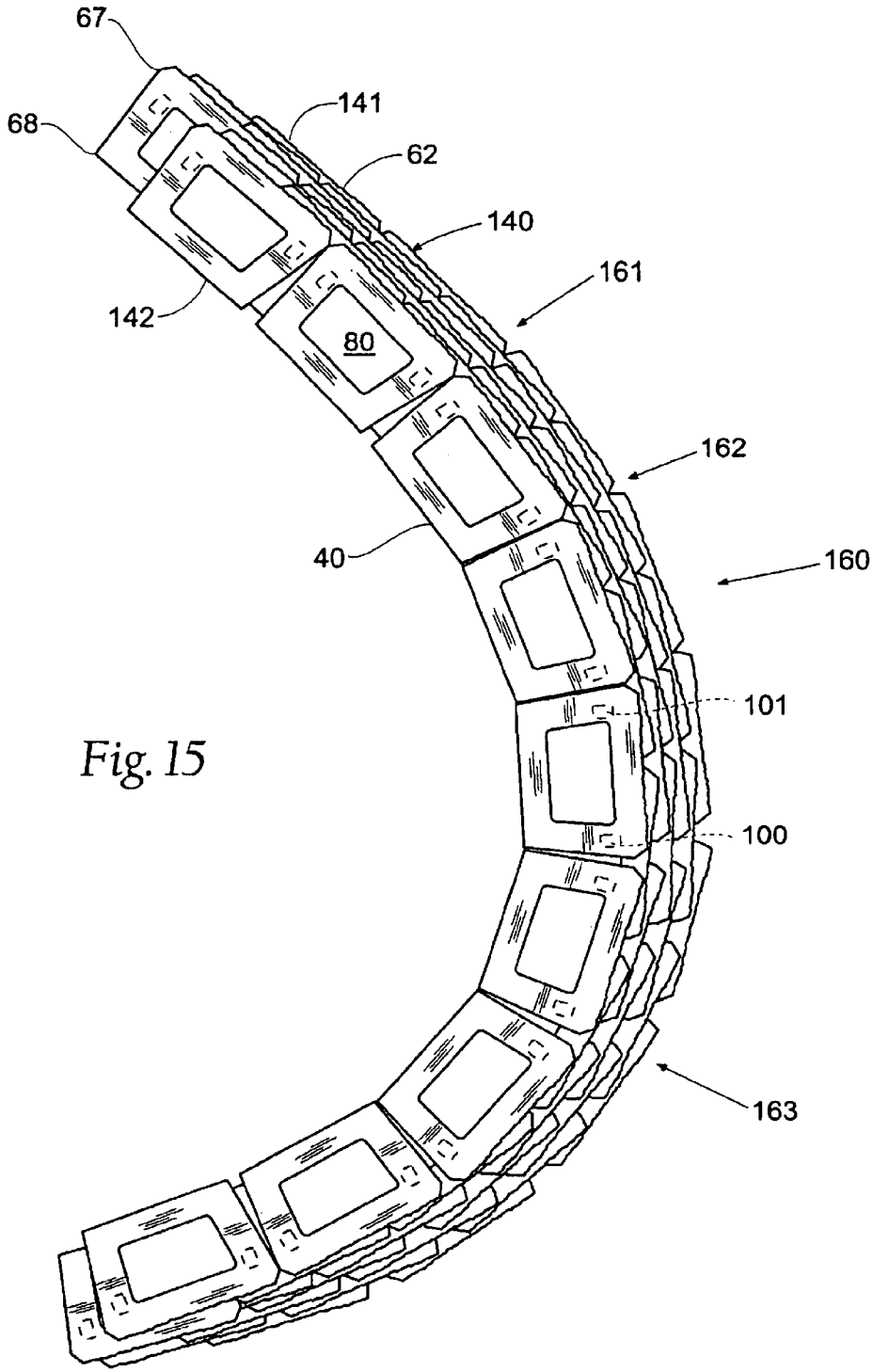
FIG. 15 is a top view of a concave shaped retaining wall formed by the first embodiment of the present interlocking masonry wall blocks with a pitch of Ps=1 in the straight section, and about Pmr=1.4 in the medium radius section, and about Phr=1.8 in the high radius section.
Figure 16:
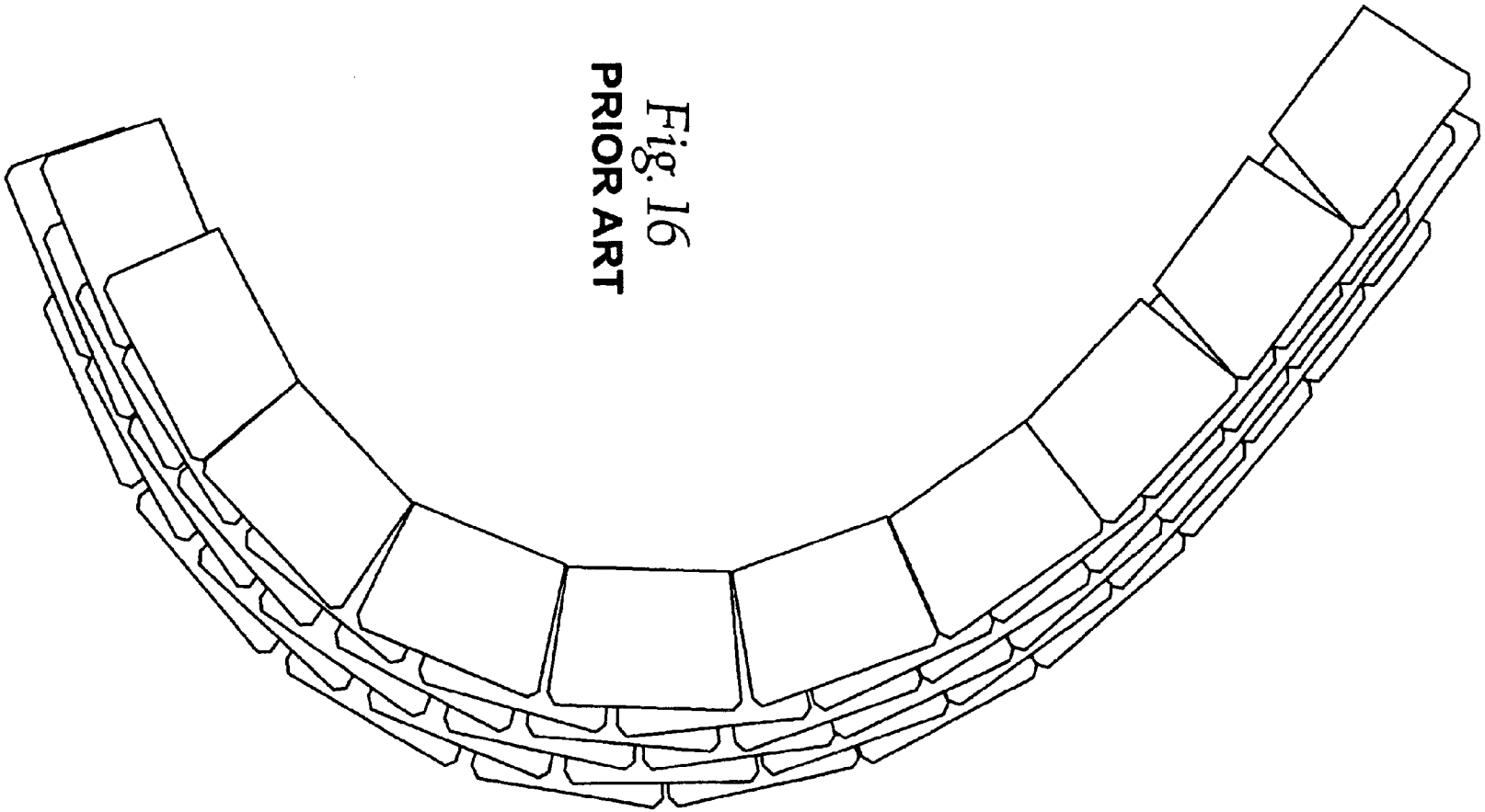
Fig. 16 PRIOR ART
FIG. 16 is a top view of a concave shaped retaining wall formed by a conventional, rear flange, interlocking masonry wall blocks with a pitch of Ps=1 in the straight section, and about Pmr=1.4 in the medium radius section, and about Phr=2.0 in high radius section.

When erecting a wall 140, a gravel or sand bed 179 is preferably formed to level the terrain 32 where the first course 141 of blocks 40 is to be laid. In each course 141 or 142, the front and rear side edges 67 and 68 of laterally adjacent blocks 40 are aligned. The front edges 67 are aligned in abutting engagement in straight wall portions 150 as shown in FIGS. 2 and 13, low radius concave wall portions 161 as shown in FIGS. 11 and 15, and all convex wall portions 170–173 as shown in FIGS. 12 and 13. The front and rear edges 67 and 68, as well as the entire outside surfaces 62 of side walls 53 or 54 of adjacent blocks 40 are flushly aligned in abutting engagement for a medium radius concave wall portions 162 as shown in FIG. 11. High radius concave wall portions 163 are formed by aligning the rear edges 68 of adjacent blocks 40 as shown in FIG. 11. The lower surface 45 of each block 40 in the first or lowest course 141 is placed at the same horizontal level, which is deemed the ground level 22. In the first course 141, the projections 100 and 101 can extend into the gravel or sand bed 179. The upper surfaces 44 of the blocks 40 forming the lower course 141 form a generally horizontal platform upon which the upper course 142 can be stacked. The lower surface 45 of each block 40 in each stacked, upper course 142 is placed on and rests on the upper surfaces 44 of the blocks in the lower course 141 upon which it is placed.

An interlocking fit is achieved between the like-shaped blocks 40 in adjacent upper 142 and lower 141 courses. Each block 40 in the upper course 142 is laid in a staggered manner relative to the lower course 141 so that the upper block is placed atop two lower blocks. Each block 40 in the upper course 142 is placed so that one of its lug-shaped projections 100 and 101 extends into and is received by the open core 80 of one of the lower blocks. The other projection 100 or 101 extends into and is received by the open core 80 of an adjacent lower block. The front surface 111 of each lug 100 and 101 of the upper block 40 abuts the inside surface 61 of the front wall 51 of its respective lower block. This abutting engagement between the upper and lower blocks 40 in adjacent courses 141 and 142 forms the interlock that prevents the block in the upper course 142 from moving forward. This interlock enables the blocks 40 in the upper courses 142 to resist the pressure of the earth and hill 20 behind the wall 140.

Figure 10:
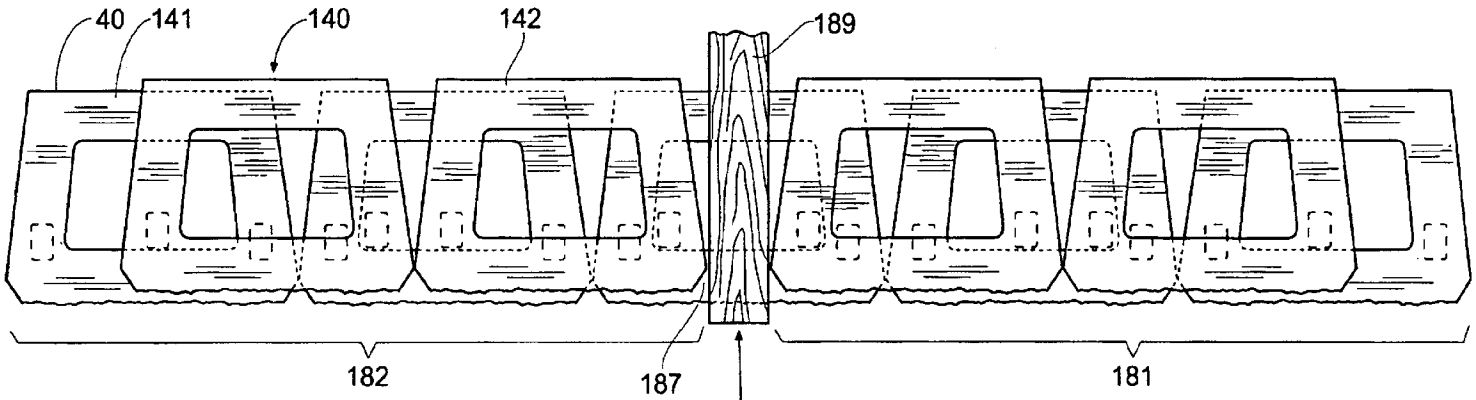
FIG. 10 is a top view of two courses of the first embodiment of the present like-shaped interlocking blocks arranged in a straight configuration with the blocks in the upper course having an offset alignment to create an opening for a drain pipe, the blocks on the right being in about a full right alignment and the blocks on the left being in about a full left alignment.

A further aspect of the interlocking fit is achieved by aligning the block 40 in the upper course 142 so that one of its projections 100 or 101 abuts the rounded corner 82 or inside surface 61 of the side wall 53 or 54 of the block in the lower course 141. When in a full right 181 or full left 182 alignment as shown in FIG. 10, the blocks 40 in the upper course 142 are prevented from sliding sideways or laterally relative to the blocks in the lower course 141. The block 40 in the lower course 141 experiences a similar resistance to movement in the opposite lateral direction. A block in a middle course may experience a resistance to both right and left movement.

Adjacent blocks 40 in a particular course 141 or 142 can also be arranged in an offset alignment 185. One block 40 can be positioned in a full right alignment 181 and its adjacent block can be position in a full left alignment 182 to form a gap or opening 187 between the two blocks shown as in FIGS. 2 and 10. The maximum amount of offset of the preferred embodiment of the block 40 is about six (6) inches. The ability to laterally offset adjacent blocks 40 to create openings 187 in the otherwise solid wall 140 enables the wall to accommodate drainage pipes, gutter down spouts, sump pump piping or other obstacles, and helps prevent excessive water building up behind the retaining wall.

As discussed above, the projections 100 and 101 produce an amount of setback 120 between the upper and lower courses of blocks 141 and 142. When the wall 140 is properly constructed, the blocks 40 in the upper course 142 are set back a predetermined amount 120 from the blocks on which they are placed. In the preferred embodiment, the outer surface 62 of the front wall 51 of the upper block 40 is set back about one quarter (¼) inch from the outer surface of the lower blocks on which it is placed. The setback dimension 120 directly affects the amount or degree of pitch P in the wall 140. The setback 120 of each block 40 in the upper course 172 is substantially the same when measured along the centerline 119 of each projection 100 or 101. When the blocks 40 form a straight wall segment 150, the height of the blocks 40 and the setback amount 120 determine the pitch of the wall. The amount of pitch can vary slightly in an actual construction setting due to the present of dirt or other debris, which can come between the lugs 100 and 101 of the upper block and the inside surface 61 of the front wall 51 of the lower block. When the blocks 40 form a curved wall segment 160 or 170, the pitch of the wall varies. For example, as shown in FIG. 13, a wall 140 having a pitch in straight wall section of Ps=1.0, should have a reduced pitch in a medium radius convex section 172 of about Pmr=0.7 times Ps, and a high radius convex section 173 of about Phr=0.4 times Ps. As shown in FIG. 15, the wall 140 should have an increased pitch in a medium radius concave section 162 of about Pmr=1.4 times Ps, and a high radius concave section 163 of about Phr=1.8 times Ps. A more consistent pitch is believed to occur with this wall 140 than in other conventional walls, such as the wall shown in FIGS. 14 and 16, because the lug-shaped projections 100 and 101 do not span the entire width of the block 40, and are located toward the front wall 5 land inwardly from the outside surfaces 62 of the side walls 53 and 54.

The top course of blocks 40 in the landscape retaining wall 140 is preferably capped by cap stones 195 to cover the open cores 80 of the blocks 40 that form the top course or portion of a course. These cap stones 195 provide a finished look to the wall. These cap stones 195 can be glued or otherwise adhered to the upper surface 44 of the blocks 40.

FIGS. 17–26 show a second interlocking masonry wall block design that is generally indicated by reference number 200. In the preferred embodiment, the block 200 has a main body 205 with a generally trapezoidal shape when viewed from above. The main body 205 with a height dimension of about six (6) inches, a depth dimension of about eight (8) inches and a width dimension of about twelve (12) inches at its widest point. However, it should be understood that these dimensions can vary without departing from the broad aspects of this inventive block design. Similarly, it should be understood that the broad aspects of the design are not limited to a block with a trapezoidal shape, but would apply to other block shapes such as a square or rectangular shaped block. While the preferred block material is a masonry product, it should be understood that other weather resistant materials such as hardened plastic could be substituted without departing from the broad aspects of the invention.

Figure 17:
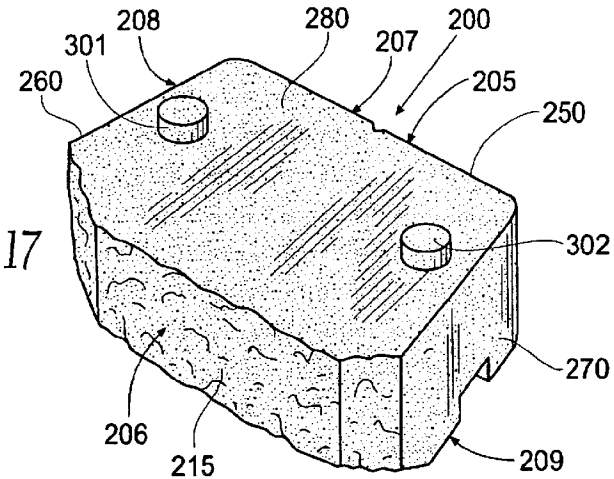
FIG. 17 is an elevated, front perspective view of the second embodiment of the interlocking masonry wall block showing the trapezoidal shape of the upper surface and the circular shape of the lugs.
Figure 19:
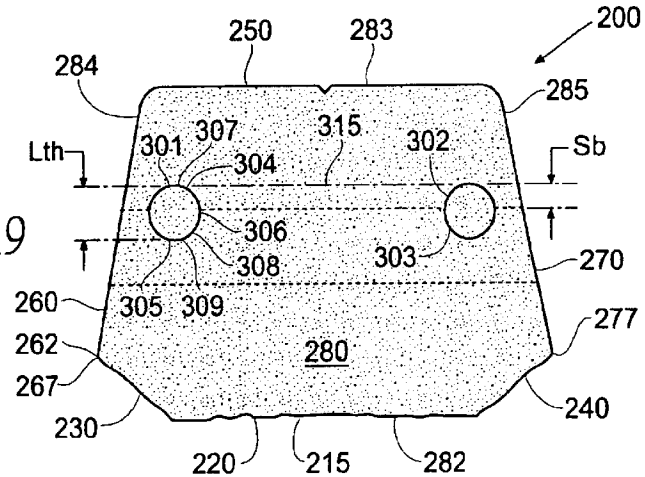
FIG. 19 is a top view of the second embodiment of the interlocking masonry wall block showing the locking lugs in offset relation to the channel.

As shown in FIGS. 17 and 19, the main body 205 of the block 200 has a front end 206, a rear end 207 and sides 208 and 209. The front end 206 has a multi-faceted front wall 215. The front wall 215 has a central wall 220 and two outer walls 230 and 240. Each wall 220, 230 and 240 has a relatively planar shape with a roughened or otherwise textured surface. The center wall 220 has a top 221, two opposed sides 222 and 223, and a bottom 224. The center wall 220 is about eight (8) inches wide. The bottom half inch of the center wall 220 has a chamfer 225. The chamfer 225 has an angle of about 45 degree from the surface of the central wall. Each outer wall 230 and 240 has a top 231 or 241, an inner side 232 or 242, an outer side 233 or 243, and a bottom 234 or 244. The inner side 232 of outer wall 230 joins the first side 222 of the center wall 220 to form a first facet. The inner side 242 of outer wall 240 joins the second side 223 of the central wall 220 to form a second facet. The outer walls 230 and 240 angle back toward the rear end 207 of the block 200. The outer walls 230 and 240 have relatively planar surfaces. If the planar surfaces of outer walls 230 and 240 were extended, they would intersect at an angle of angle of about 110 degrees. The width of the front end 206 of the block 200 between the outer ends 233 and 243 of the front wall 215 is about twelve (12) inches. Similar to the central wall 220, the bottom half inch of each outer wall 230 and 240 has a chamfer 235 or 245. These chamfers 235 and 245 also have an angle of about 45 degrees.

Figure 23:
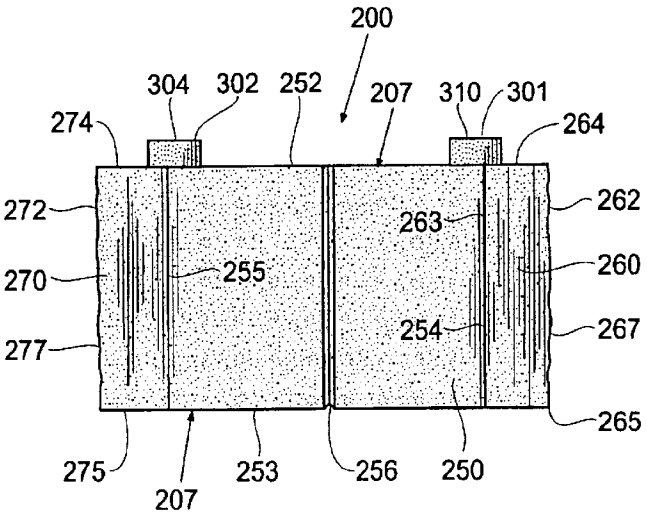
FIG. 23 is a rear view of the second embodiment of the interlocking masonry wall block.

The rear end 207 of the block 200 is shown in FIG. 23. The rear end 207 is formed by a rear wall 250 that is substantially parallel to the center wall portion 220 of the front wall 215. The rear wall 250 has a top end 252, bottom end 253, and opposed sides ends 254 and 255. The rear wall 250 has a width dimension of about nine (9) inches. A V-shaped groove 256 is formed into the rear wall 250. This groove 256 extends form the top 252 to the bottom 253 of the wall 250. The groove helps split the block into two symmetrical halves. The vertical groove 256 is parallel to side ends 254 and 255 and is perpendicular to top and bottom ends 252 and 253. The rear wall 250 is symmetrical about both sides of the groove 256.

Figure 18:
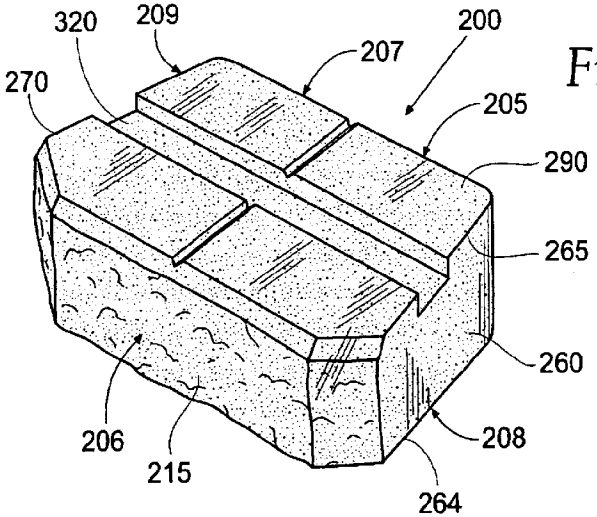
FIG. 18 is a lowered, front perspective view of the second embodiment of the interlocking masonry wall block showing the trapezoidal shape of the lower surface, the channel extending parallel to the front wall, and the splitting groove.

The first side end 208 of the block 200 has a first side wall 260 as shown in FIG. 18. The side wall 260 has a front end 262, a rear end 263, and top and bottom ends 264 and 265 that form the perimeter of the side wall. The front end 262 joins with the outer end 233 of outer wall 230 of the front wall 215 to form a first pivot joint 267. The rear end 263 joins with the side end 254 of rear wall 250 to form a first rear corner. This first rear corner is rounded to form a three-quarter (¾) inch radius curve.

Figure 22:
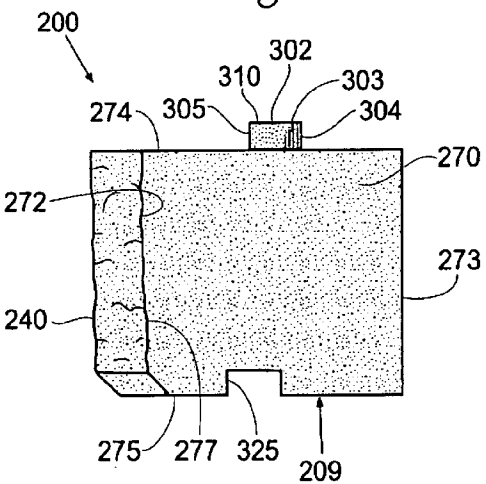
FIG. 22 is an end view of the second embodiment of the interlocking masonry wall block showing the lug and channel in offset relation.
Figure 21:
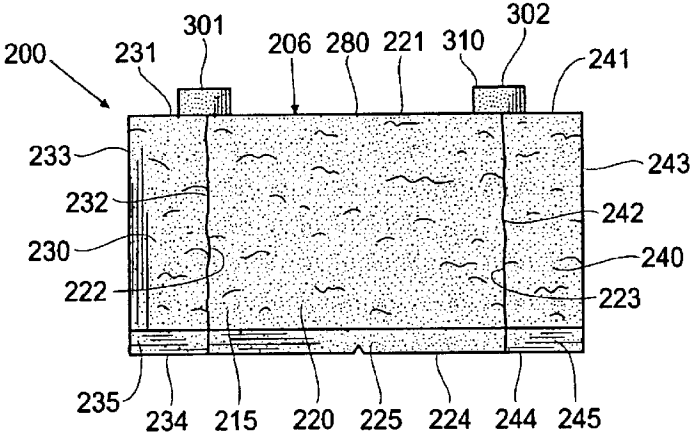
FIG. 21 is a front view of the second embodiment of the interlocking masonry wall block.

The second side end 209 of the block 200 has a second side wall 270 as shown in FIGS. 17 and 22. This side wall 270 has a front end 272, a rear end 273, and top and bottom ends 274 and 275 that form the perimeter of the side wall. The front end 272 joins with the outer side 243 of the outer wall 240 of front wall 215 to form a second pivot joint 277. The rear 273 joins with the side end 255 of rear wall 250 to form a second rear corner. This second rear corner is also rounded to form a three-quarter (¾) inch radius curve.

In the preferred embodiment, the side walls 260 and 270 converge as they extend from the front end 206 towards the rear end 207 of the block 200. As noted above, the side walls 260 and 270 are spaced twelve (12) inches apart where they joint with the first and second outer walls 230 and 240 of the front wall 215, respectively. The side walls 260 and 270 are spaced nine (9) inches apart where they join with the side ends 254 and 255 of the rear wall 250 of the block 200, respectively. However, it should be understood that the broad aspects of the invention are not limited to a block with converging side walls 260 and 270. The broad aspect of the inventive block design are also applicable to a block with parallel side walls.

Figure 24:
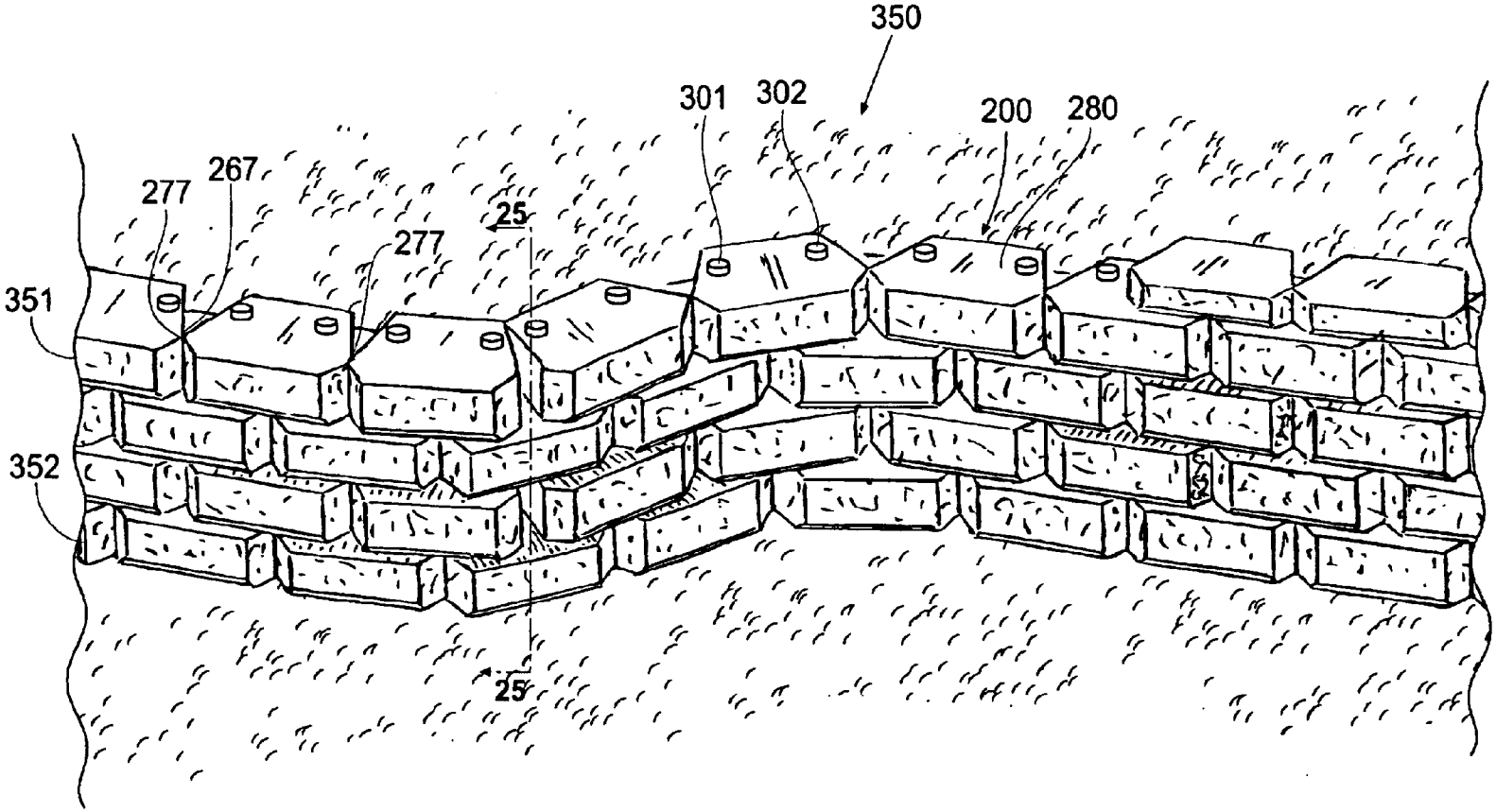
FIG. 24 is a perspective view showing a serpentine wall formed from the second embodiment of the interlocking masonry wall blocks.

The block 200 has an upper surface 280 shown in FIGS. 17, 19 and 24. The upper surface 280 has a generally trapezoidal shape. The upper surface 280 is perpendicular to the front wall 215, rear wall 250, and side walls 260 and 270. The upper surface 280 has a front end 282, rear end 283, first and second side ends 284 and 285. The front 282 joins the top ends 221, 231 and 241 of the multi-faceted front wall 215. The rear end 283 joins the top 252 of the rear wall 250. The first side end 284 joins the top end 264 of the first side wall 260. The second side 285 joins the top end 274 of the second side wall 270.

Figure 20:
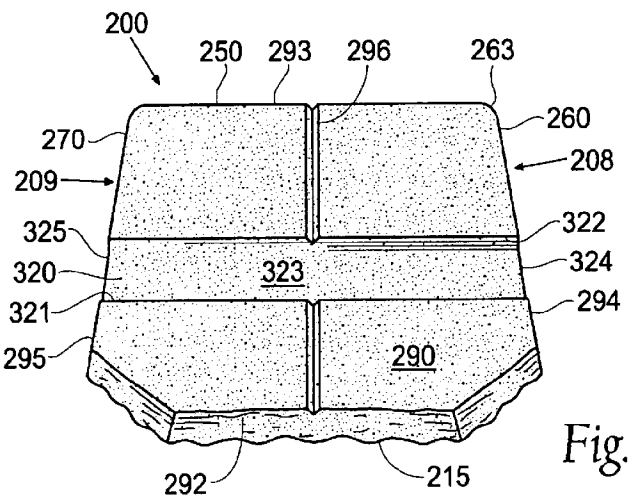
FIG. 20 is a bottom view of the second embodiment of the interlocking masonry wall block showing the channel in offset relation to the lugs.

The block 200 has a bottom surface 290 shown in FIGS. 18 and 20. The bottom surface 290 is substantially parallel to the upper surface 281, and is perpendicular to the front wall 215, rear wall 250, and side walls 260 and 270. The lower surface 290 has a front end 292, rear end 293, and first and second side ends 294 and 295. The front end 292 joins the chamfers 225, 235 and 245 located on the front multi-faceted wall 215. The rear end 293 joins the bottom end 253 of the rear wall 250. The first side end 294 joins with the bottom end 265 of the first side wall 260. The second side end 295 joins with the second side wall 270. A V-shaped groove 296 is formed in the lower surface 290 of the block 200. The groove 296 is similar to groove 256, and combines with this groove to help split the block into two symmetrical halves.

Two lugs or protrusions 301 and 302 extend from the upper surface 280 of the block 200. The lugs 301 and 302 are spaced apart and generally extend perpendicularly from the upper surface 280. Although the protrusions 301 and 302 are discussed and shown as lugs, it should be understood that these protrusions could take on a variety of shapes, such as a foot, nub, fin, tab, or stump. Each lug 301 and 302 is integrally formed with the main body 205 of the block 200. Each lug 301 and 302 has a lug wall 303 that is circular in shape with a rearmost point 304 and a front most point 305. The distance between the rearmost and front most points 304 and 305 of each lug 301 or 302 define a thickness or diameter dimension $L_{th}$ of that lug, which is preferably 1⅜ inches. Each lug 901 and 902 has a center point or axis. Although the lug walls are shown as having a circular shape, it should be understood that they could had an other arcuate shape or a square, triangular or rectangular shape in which the front most and rearmost points are formed by a flat surface. The lug walls 303 are preferably inwardly drafted or angled about 1 degree to facilitate manufacture. Each lug 301 or 302 has a rearward setback portion 306 with a corresponding rearward facing setback wall 307, and a forward reinforcement portion 308 with a corresponding forward facing reinforcement wall 309. Each lug 301 and 302 has a top surface 310 that extends about a half (½) inch from the upper surface 280 of the block 200. Each lug 301 and 302 is about ⅝ inch from its corresponding side wall 260 or 270, and 1⅞ inches from the rear wall 250 as shown in FIG. 19. Although the lugs 301 and 302 are shown specific distance from their respective side walls 260 and 270 and a specific distance from the rear wall 250, it should be understood that the lugs could be located farther from or closer to the rear wall 250 or side walls 260 and 270 without departing from the broad aspects of the invention. The rearmost portions 313 of each lug 301 and 302 define a setback line 315 that is substantially parallel to the center wall 220 of the front wall 215 and the rear end 250 of the block 200.

The bottom or lower surface 290 of the block 200 has an abutment forming mechanism such as channel 320 shown in FIGS. 18 and 20. The channel 320 extends the width of the block 200 or from one side 260 of the block to the other 270. The channel 320 has forward 321 and rearward 322 channel walls. The forward wall 321 faces rearwardly toward the rear end 207 of the block. The rearward wall 322 faces forwardly toward the front end 206 of the block. The channel 320 and its walls 321 and 322 are substantially perpendicular to the lower surface 290 and substantially parallel to the setback line 315 and the central wall 220 of the block. Each wall 321 and 322 is outwardly drafted 1 degree to facilitate manufacture. The channel walls 321 and 322 are have a continuous planar shape. The walls 321 and 322 are parallel and are spaced apart a constant predetermined dimension to define the width of the channel 320. The channel width is preferably about 1½ inches, or just slightly larger than the thickness or diameter $L_{th}$ of the lugs 301 and 302. The channel 320 has a base surface 323 that is spaced from the lower surface 290 of the block 200 to define the depth dimension of the channel 320, which is preferably about a half (½) inch. The channel 320 has a depth dimension that is sufficiently large to allow the channel to completely receive the lugs 301 and 302. The length of the channel 320 is defined by its ends 324 and 325. Each end 324 and 325 forms a slot in its respective side wall 260 and 270. Although the abutment forming mechanism 320 is discussed and shown as a channel, it should be understood that the recess could take a variety of forms, such as a wedge shaped groove or recess, or the like that forms a forward-facing abutment mechanism and can completely receive the projections such as the lugs 301 and 302.

The rearward wall 322 of the channel 320 is located about 3¼ inch from the back of the block 200. The setback line 315 and the rearmost points 304 of the lugs 300 and 301 are spaced about ⅝ inch from the forward facing rearward wall 322 of the channel 320 to define a setback dimension Sb of the block 200. In other words the setback line 315 is located about ⅝ inch further from the central portion 220 of the front wall 210 than the rearward wall 322 of the channel 320. In the preferred embodiment, the centerline or axis of each lug 301 and 302 lies in the same plane as the rearward wall 322. Because the distance between the rearmost point 304 of the lugs 301 and 302 and the rearward wall 322 of the channel 320 controls the setback, the overall thickness or diameter dimension $L_{th}$ of the lugs 301 and 302 does not necessarily affect the setback dimension Sb. Instead, the setback dimension Sb is determined by the location of the rearward wall 322 of the channel 320 relative to the setback line 315 formed by the lugs 301 and 302.

Figure 25:
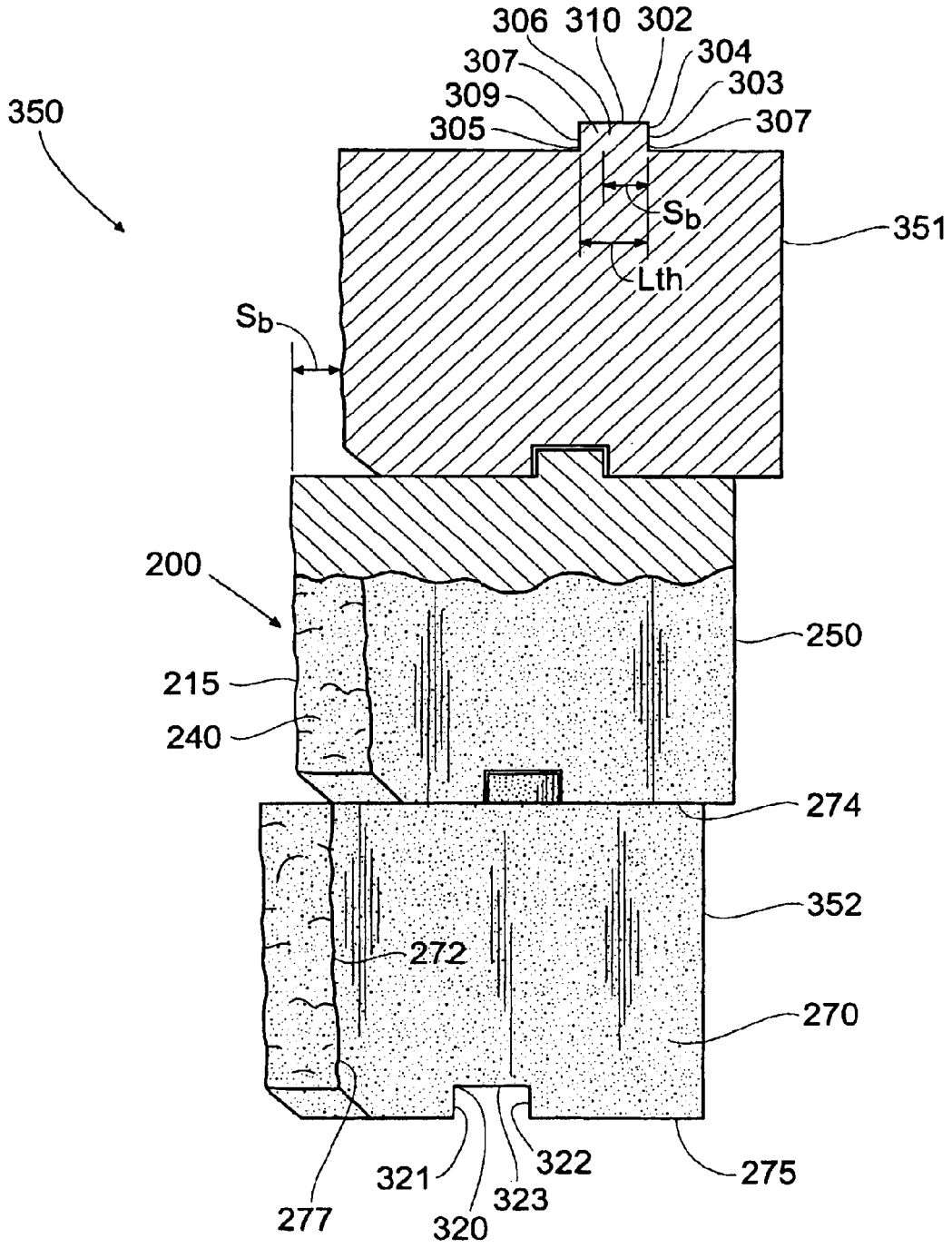
FIG. 25 is a sectional view of FIG. 24 taken along line 25—25 showing the setback relation of the second embodiment of interlocking masonry wall blocks.
Figure 26:
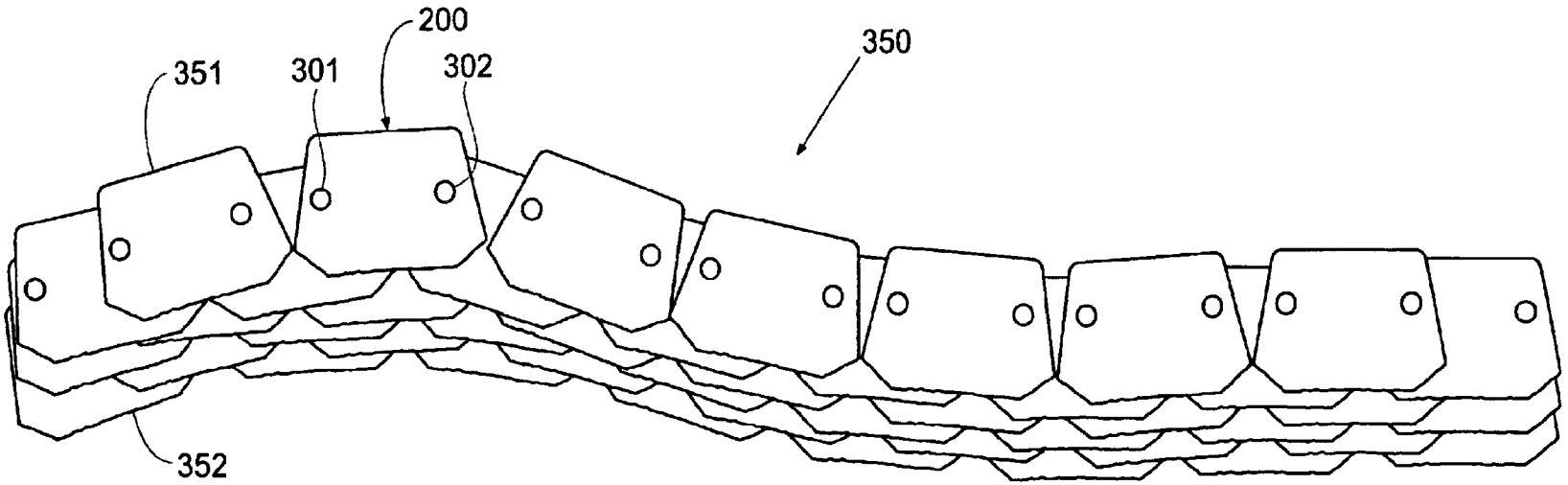
FIG. 26 is a top view of a wall formed from the second embodiment of interlocking masonry wall blocks.

Like-shaped blocks 200 are used to form a straight or serpentine wall 350 as shown in FIGS. 24–26. The wall 350 has a number of tiers or courses of blocks 200. The blocks 200 in each course are placed in horizontal alignment. An end block in each course has only one horizontally adjacent block. The middle blocks in each course have two horizontally adjacent blocks. The left pivot joint 267 of each middle block 200 abutingly engage the right pivot joint 277 of its left adjacent block. The right pivot joint 277 of each middle block 200 abuttingly engages the left pivot joint 267 of its right adjacent block.

An upper course 351 of blocks 200 is placed on top of its immediately lower course 352. The lugs 301 and 302 of the blocks 200 in the lower course 352 are received by the channel 320 of blocks in the immediately upper course 351. The lugs 301 and 302 are completely received by the channels 320 so that the lower surface 290 of the blocks 200 in the upper course 351 lay flushly against and in parallel alignment with the upper surface 280 of the blocks in the lower course 352. As best shown in FIG. 25, each block 200 in the upper course 351 is rearwardly offset ⅝ inch in relative to the blocks 200 upon which it lays in the immediately lower course 352. The channel 320 has a constant cross-sectional size and shape from one side 280 of the block to the other 270 so that it can receive the lugs 300 and 301 anywhere within its tract.

The blocks 200 forming the upper course 351 are preferably horizontally staggered relative to the blocks forming the immediate lower course 352. Each block 200 in the upper course 351 is preferably laterally staggered about half the width of the block relative to the two blocks upon which it lays in the lower course 352. When placed in this staggered relationship, the channel 320 of the upper block in the upper course 351 receives the right lug of a first lower block in the lower course 352 and the left lug of a second lower block in the lower course. The forward facing rearmost wall 322 of the channel 320 abuttingly engages the rearmost point 304 of each of the lugs 301 and 302 it receives from its first and second lower blocks. The block 200 in the upper course 351 is rearwardly set back from its two lower blocks a distance substantially equal to the setback dimension Sb of the block. This distance is equal to the setback dimension Sb for straight wall sections as shown in FIG. 25. This process of laying or arranging the blocks in this staggered relationship is repeated for each block 200 in each upper course 351 until the desired wall height is achieved. Once construction is complete, a cap stone (not shown) can be placed on the upper most course 351, or the lugs 301 and 302 on that course can be removed for aesthetic purposes.

When building a serpentine wall, one of the lugs 301 or 302 of some of the block 200 can be removed to avoid discontinuities in the wall pattern and create a smooth serpentine wall 350. The ability to periodically remove one of the lugs can be particularly advantageous when building a wall with a tight radius curve. The structural integrity of the wall 350 should not be significantly affected by occasionally removing one of the lugs 301 or 302. As should be evident, this single type of like-shaped block 200 is used to construct a variety of retaining wall layouts or patterns. The end block 200 of a course can be split along grooves 256 and 296. One half of the block is positioned at an end of the lower course 352. The second half of the split block 200 is placed on the opposite end of the row to complete a staggered upper course 351.

Although the block 200 has been shown and described to have a preferred geometric shape, it should be understood that certain aspects of this geometry can change without departing from the broad aspects of this embodiment. For example, in warmer climates where freezing and thawing are not a significant concern, the channel 320 can be located on the top surface 280 and the lugs 301 and 302 can be located on the bottom surface 290. In this configuration, the setback portion 306 of each lugs 301 and 302 would be forward of the rearward facing front most wall 322 of the channel 320. In addition, the angles of the outer walls 230 and 240 of the multi-faceted front wall 215 can vary, or the facets can be eliminated so that the front wall 215 has a single planar surface from one outer end 233 to the other 243. Additionally, several grooves can be formed in the block 200 to allow smaller or larger portions of the block to be split off to form the end blocks of each course 351 and 352 to accommodate different amounts of stagger.

FIGS. 27–29 show a third interlocking masonry wall block design that is generally indicated by reference number 400. The block 400 has a main body 405 with a trapezoidal shape. The block 400 has a front end 406, a rear end 407 and sides 408 and 409. The front end 406 has a roughened, multi-faceted front wall 410. The rear end 407 has a V-shaped configuration with an angled rear wall or surface 420. This angled wall 420 forms a recess 421. The block 400 has upper and lower surfaces 430 and 440 that are substantially flat, solid and parallel to each other. The sides 408 and 409 have opposed side walls or surfaces 450 and 460 that are substantially solid and flat. The rear end 407 has two opposed columns or shelves 471 and 472 that span the height of the block 400. Each column 471 and 472 forms a lug 501 or 502 that extend from the lower surface 440 of the main body 405. Each lug 501 and 502 is offset from its respective column 471 or 472.

The front wall 410 has a central face 411 and two outer faces 412 and 413. The central face 411 is generally planar.

The outer faces 412 and 413 angle away from the plane formed by the central face 411, and extend toward the rear end 407 of the block 400. The faces 411, 412, and 413 of the front wall 410 are solid, have a roughened texture, and extend the height of the block 400. The outer faces 412 and 413 of the front wall 410 are shorter in width than the central face 411. The outer faces 412 and 413 are located on opposite ends of the central face and join with the side walls 450 and 460. The side walls 450 and 460 join the outer front walls 412 and 413 at the front end 406 of the block 400 and angle back toward the rear end 407. The side walls 450 and 460 converge as they extend from the front end 406 to the rear end 407 so that the main body 405 of the block 400 decreases in width toward the rear end 407.

The columns 471 and 472 are spaced apart and located at the rear corners of the block 400. The columns 471 and 472 extend from their respective side wall 450 or 460 towards the middle of the block 400. Each column 471 and 472 has a width dimension of about one and a half (1½) inches. The ends or lugs 501 and 502 of the columns 470 and 471 extend beyond the lower surface 440 of the main body 405. The lugs 501 and 502 are offset from the angled wall 420. The lugs 501 and 502 have a front surface 510, a rear surface 511, an outer side surface 512, an inner side surface 513, and a bottom surface 514. The lugs 501 and 502 are mirror images of each other and are substantially equal in corresponding dimensions. The outer side surface 512 is longer than the inner side surface 513. The front and rear surfaces 510 and 511 are angled. The angle of the front surface 510 of each of the lugs 501 and 502 relative to the central wall 411 correspond to the angle of the opposite side of the V-shaped wall 420 relative to the central wall. Thus, when the block 400 is stacked in a staggered relationship atop two lower like-shaped blocks 400 to construct a straight wall, the front surface 510 of each lug 501 or 502 of the upper block flushly engages the V-shaped rear wall 420 of one of the lower blocks.

FIGS. 30–32 show a fourth interlocking masonry wall block design that is generally designated by reference number 600. The block 600 has a main body 605 with a similar trapezoidal shape as block 400. The block 600 has a front end 606, a rear end 607 and sides 608 and 609. The front end 606 has a roughened, multi-faceted front wall 610. The front wall 610 is formed by a central wall 611 and two angled outer walls 612 and 613. The rear end 607 has a recess 621 formed by a recess wall 622 that is flat and substantially parallel to the central wall 611. The block 600 has two indentations or hand holds 631 and 641 formed in the respective side surfaces 630 and 640 of the block 600.

The blocks 600 have two spaced apart lugs 701 and 702 at the rear end 607 of the block 400. The lugs 701 and 702 span the height of the main body 605 and are located in the rear corners of the block 600. The lugs 701 and 702 have a square shape when viewed from above. Each lug 701 and 702 has a front wall 705, back wall 706, and first and second side walls 707 and 708. The inside walls 708 of lugs 701 and 702 form the side walls of the recess 621.

Like-shaped blocks 600 can be stacked in a staggered relationship where an upper block resting on two lower blocks. When stacked in this manner, the front wall 705 of lugs 701 and 702 of the upper block abuttingly engages the recess wall 622 of the lower block. The front wall 610 of the upper block is set back relative to the front wall of the lower block. The setback dimension between two blocks 600 is the distance between the front wall 705 of the lugs 701 and 702 and the recess wall 622 of the rear end 607 of the same block 600.

FIGS. 33–42 show a fifth interlocking masonry wall block design that is generally designated by reference number 800. In its preferred embodiment, the block 800 has a main body 805 with a generally trapezoidal shape when viewed from above. The main body 805 has a height dimension of about four (4) inches, a depth dimension of about nine (9) inches and a width dimension of about twelve (12) inches. However, it should be understood that these dimensions can vary without departing from the broad aspects of this inventive block design. Similarly, it should be understood that the broad aspects of the block are not limited to a block with a trapezoidal shape, but would apply to other block shapes such as a square or rectangular shaped block.

The block 800 has a front end 806, a rear end 807 and sides 808 and 809, as shown in FIGS. 33–35. The front end 806 is substantially the same as the front end 206 of block 200. The front end 806 has a multi-faceted front wall 815. The front wall 815 has a central wall 820 and two outer walls 830 and 840. Each wall 820, 830 and 840 has a relatively planar shape with a roughened or otherwise textured surface. The center wall 820 has a top 821, two opposed sides 822 and 823, and a bottom 824. The center wall 820 is about eight (8) inches wide. The bottom half inch of the center wall 820 has a chamfer 825. The chamfer 825 has an angle of about 45 degree from the surface of the central wall. Each outer wall 830 and 840 has a top 831 or 841, an inner side 832 or 842, an outer side 833 or 843, and a bottom 834 or 844. The inner side 832 of outer wall 830 joins the first side 822 of the center wall 820 to form a first facet. The inner side 842 of outer wall 840 joins the second side 823 of the central wall 820 to form a second facet. The outer walls 830 and 840 angle back toward the rear end 807 of the block 800. The outer walls 830 and 840 have relatively planar surfaces. If the planar surfaces of outer walls 830 and 840 were extended, they would intersect at an angle of angle of about 110 degrees. The width of the front end 806 of the block 800 between the outer ends 833 and 843 of the front wall 815 is about twelve (12) inches. Similar to the central wall 820, the bottom half inch of each outer wall 830 and 840 has a chamfer 835 or 845. These chamfers 835 and 845 also have an angle of about 45 degrees.

Figure 38:
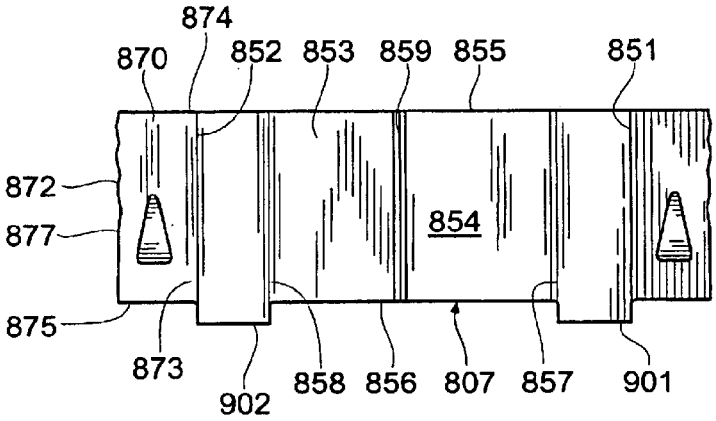
FIG. 38 is a rear view of the fifth embodiment of masonry wall block showing the well wall and lug's arcuate shaped side walls.

The rear end 807 of the block 800 is shown in FIG. 38. The rear end 807 is about nine (9) inches wide and has a recess 853. The recess 853 is centrally located on the rear end 807 and is six (6) inches wide. The recess 853 is formed by a recess wall 854 that is generally parallel to the central wall 820 of the front end 806. The recess wall 854 has top end 855 and bottom ends 856, and opposed side ends 857 and 858. Similar to block 200, a V-shaped groove 859 divides the recess 853 and the rear end 807 into two symmetrical halves.

Figure 39:
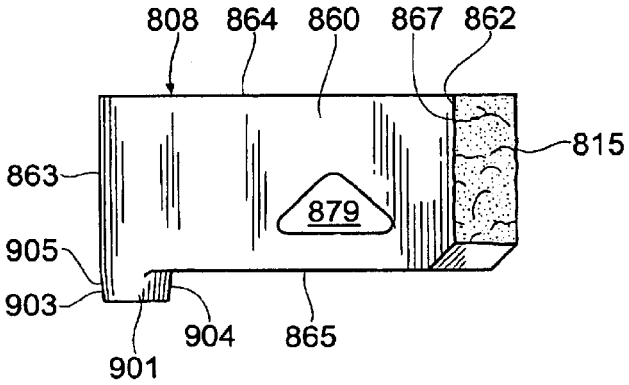
FIG. 39 is an end view of the fifth embodiment of masonry wall block showing the hollow core parallel with the front end.
Figure 40:
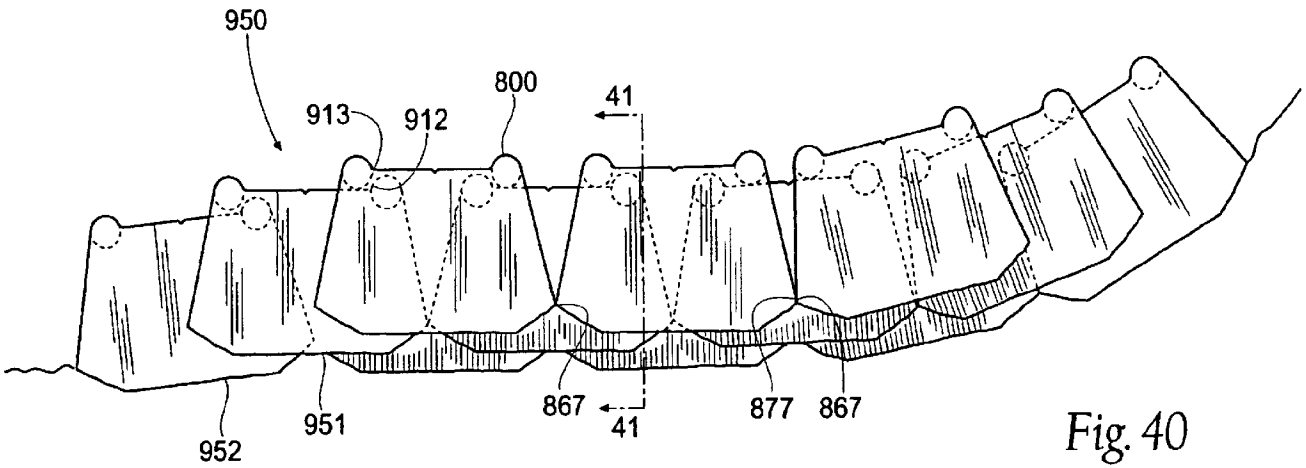
FIG. 40 is a top view of the fifth embodiment of masonry wall block showing the setback of blocks in various rows of a serpentine structure.

The first side end 808 of the block 800 has a first side wall 860 as shown in FIGS. 34 and 39. The side wall 860 has a front end 862, a rear end 863, and top and bottom ends 864 and 865 that form the perimeter of the side wall. The front end 862 of the side wall 860 joins with the outer end 833 of outer wall 830 to form a first pivot joint 867. The rear end 863 of side wall 860 joins with the side end 851 of the rear end 807 of the block 800.

The second side end 809 of the block 800 has a second side wall 870 as shown in FIG. 33. This side wall 870 has a front end 872, a rear end 873, and top and bottom ends 874 and 875 that form the perimeter of the side wall. The front end 872 of the side wall 870 joins with the outer side 843 of outer wall 840 of the front wall 815 to form a second pivot joint 877. The rear 873 of the side wall 870 joins with the side end 852 of the rear end 807 of the block 800.

In the preferred embodiment, the side walls 860 and 870 converge as they extend from the front end 806 towards the rear end 807 of the block 800. As noted above, the side walls 860 and 870 are spaced twelve (12) inches apart where they joint with the first and second outer walls 830 and 840 of the front wall 815 to form the pivot joints 867 and 877. The side walls 860 and 870 are spaced nine (9) inches apart where they join with the side ends 851 and 852 of the rear end 807 of the block 800, respectively. However, it should be understood that the broad aspects of the invention are not limited to a block with converging side walls 860 and 870. The broad aspect of the inventive block design are also applicable to a block with parallel side walls.

The block 800 has a triangular shaped core 879 spanning horizontally through the body 805 of the block. The core 879 extends from one side 860 of the block 800 to the other 870, and forms triangular shaped openings in the side walls. The core 879 reduces the weight of the block 800 and forms handholds in the sides 860 and 870 of the block. The core 879 is formed by a bottom wall and two angled side walls. The length of the core 879 and its respective walls are substantially parallel to the central wall 820 of the front end 806 of the block 800.

The block 800 has an upper surface 880 shown in FIG. 35. The upper surface 880 has a generally trapezoidal shape. The upper surface 880 is perpendicular to the front wall 815, recess wall 854, and first and second side walls 860 and 870. The upper surface 880 has a front end 882, rear end 883, first and second side ends 884 and 885. The front end 882 joins the top ends 821, 831 and 841 of the multi-faceted front wall 815. The rear end 883 joins the top 855 of the recess wall 854. The first side end 884 joins the top end 864 of the first side wall 860. The second side 885 joins the top end 874 of the second side wall 870.

Figure 37:
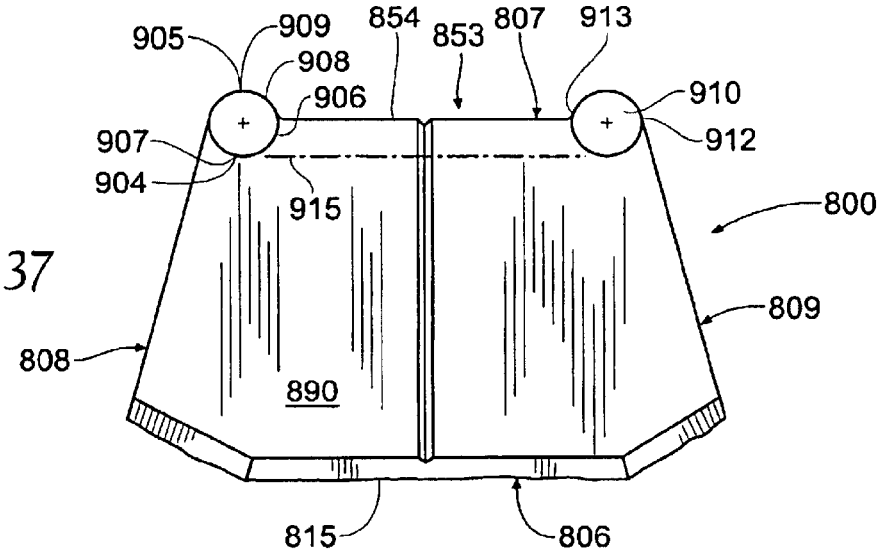
FIG. 37 is a bottom view of the fifth embodiment of masonry wall block showing its generally trapezoidal shape and the ends of the lugs.

The block 800 has a lower or bottom surface 890 shown in FIG. 37. The lower surface 890 is substantially parallel to the upper surface 881, and is perpendicular to the front wall 815, recess wall 854, first and second side walls 860 and 870. The lower surface 890 has a front end 892, rear end 893, and first and second side ends 894 and 895. The front end 892 joins the chamfers 825, 835 and 845 located on the front multi-faceted wall 815. The rear end 893 joins the bottom end 856 of the recess wall 854. The first side end 894 joins with the bottom end 865 of the first side wall 860. The second side end 895 joins with the second side wall 870. A V-shaped groove 896 is formed in the lower surface 890 of the block 800. The groove 896 is similar to groove 859, and combines with this groove to help split the block into two symmetrical halves.

Two lugs 901 and 902 are integrally formed at the rear end 807 of the block 800. The lugs 901 and 902 are spaced apart so that each lug is located at one of the ends or corner 851 and 852 of the rear end 807 of the block 800. A portion of the lugs 901 and 902 extend down from the lower surface 890 of the block 800. The lugs 901 and 902 are generally parallel to each other, and perpendicular to the upper and lower surfaces 880 and 890. Although these lugs or abutment mechanisms 901 and 902 are shown and described as lugs, it should be understood that they can take on a number of shapes or structures such as a column, shaft or post. Although the lugs 901 and 902 are shown at the rear corners 851 and 852 of the block 800, it should be understood that the lugs could be located away from the rear corners without departing from the broad aspects of the invention.

The lugs 901 and 902 are separated by or straddle the recess 853. Each lug 901 and 902 has a lug wall 903 that has a circular shape with a rearmost point 904 and a front most point 905. The distance between the rearmost and front most points 904 and 905 of the lug 901 or 902 define a thickness or diameter dimension $L_{th}$ of each lug, which is preferably about 1½ inches. In the preferred embodiment, each lug 901 and 902 has a center point or axis that lies in the same plane as the recess wall 854. Although the lug walls are shown as having a circular shape, it should be understood that they could have an other arcuate shape or a square, triangular or rectangular shape in which the front most and rearmost points 905 and 904 are formed by a flat surface. Each lug 901 or 902 has a forward setback portion 906 with a corresponding forward facing setback wall 907, and a rearward reinforcement portion 908 with a corresponding rearward facing reinforcement wall 909. The setback portion 906 is the portion of each lug 901 or 902 forward of the recess wall 854. The reinforcement portion 908 is the portion of each lug 901 or 902 rearward of the recess wall 854. Each lug 901 and 902 has a bottom surface 910 that is parallel to and is spaced about a half (½) inch below the lower surface 880 of the block 800. The wall 903 of each lug 901 and 902 includes an outside wall portion 912 that faces away from the recess 853, and an inside wall portion 913 that faces toward and helps form the recess. The outer walls 912 of each lug wall 903 flushly joins the back end 863 and 873 of its respective side wall 860 and 870. The inside portion 913 or the lug wall 903 joins with its respective end 857 and 858 of the recess wall 854. These recess joints are rounded to form a ⅜ inch radius curve. The front most points 905 of the two lugs 901 and 902 define a setback line 915 that is substantially parallel to the center wall 820 at the front end 806 and the recess wall 854 at the rear end 807 of the block. The forward-most point 904 is about ¾ inch in front of the recess wall 854.

Like-shaped blocks 200 are used to form a straight or serpentine wall 950 as shown in FIGS. 4042. The walls 950 using like-shaped blocks 800 are formed in a manner similar to walls 350 using like-shaped blocks 200. The wall 950 has a number of tiers or courses of blocks 200. The blocks 200 in each course are placed in horizontal alignment. The end blocks in each course have one horizontally adjacent block. The middle blocks in each course have two horizontally adjacent blocks. The left pivot joint 867 of each middle block 800 abuttingly engage the right pivot joint 877 of its left adjacent block. The right pivot joint 877 of each middle block 800 abuttingly engages the left pivot joint 867 of its right adjacent block.

Figure 41:
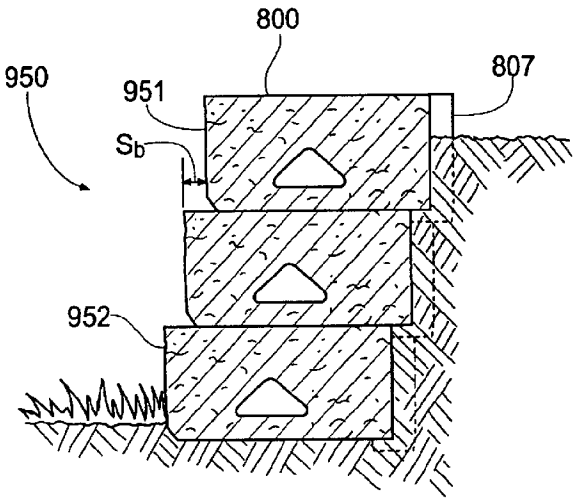
FIG. 41 is a sectional view of FIG. 40 taken along line 41—41 showing the hollow core and setback of each block relative to the row below.
Figure 42:
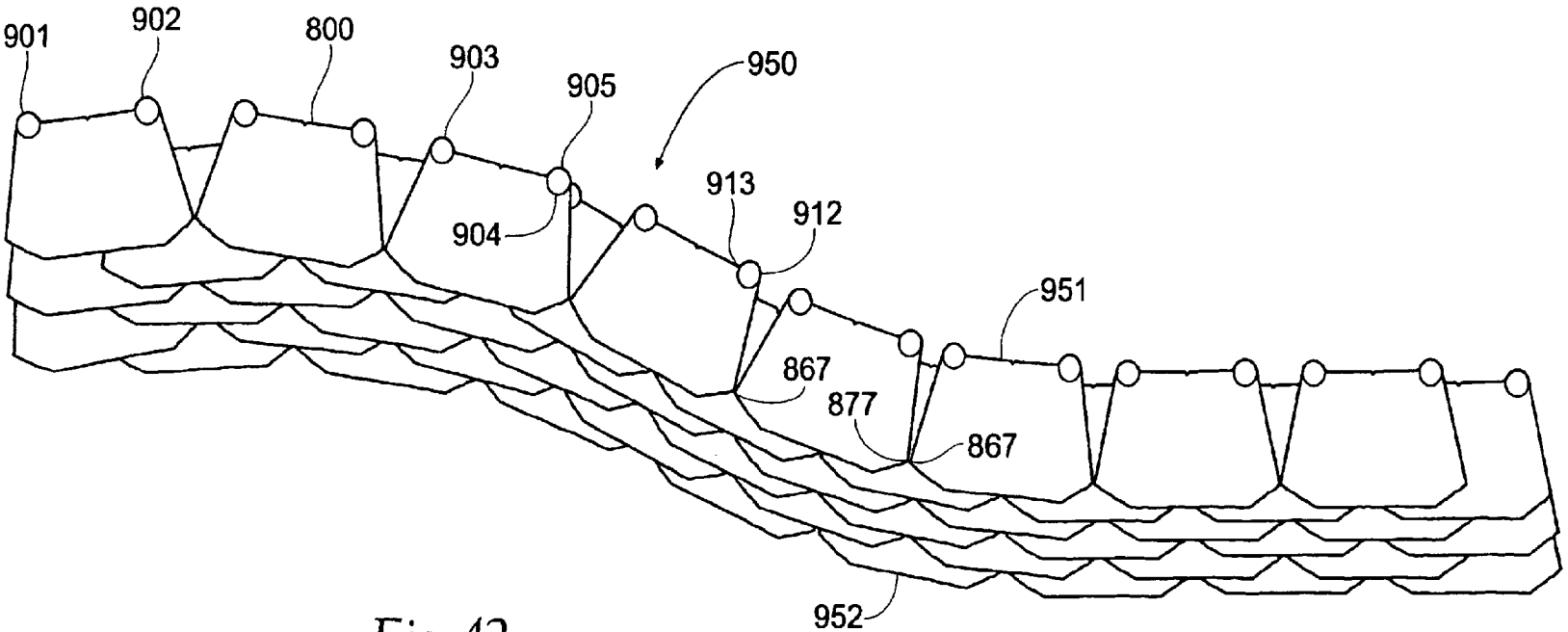
FIG. 42 is a top view of a wall constructed from the fifth embodiment of masonry wall block.
Figure 44:
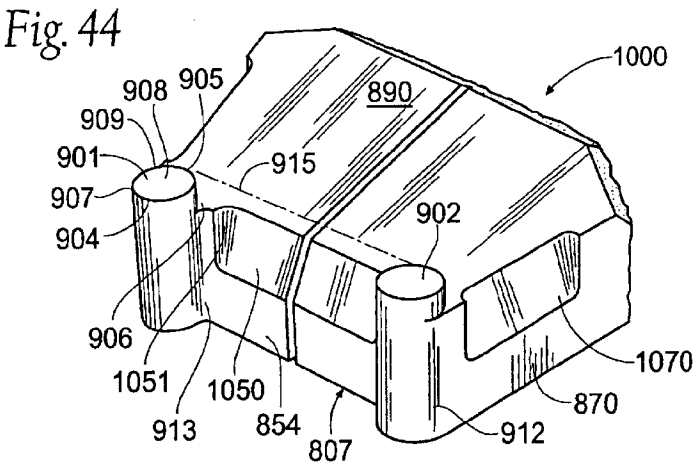
FIG. 44 is a lowered, rear perspective view of the sixth embodiment of interlocking masonry wall block showing the generally trapezoidal shape of the lower surface, and the rear having a well comprising a well wall and lug walls.
Figure 46:
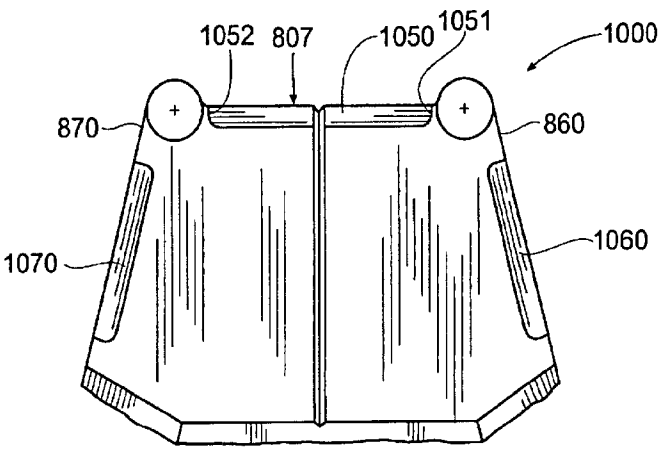
FIG. 46 is a bottom view of the sixth embodiment of the interlocking masonry wall block showing the trapezoidal shape of the lower surface and the lugs separated by the length of the well.
Figure 43:
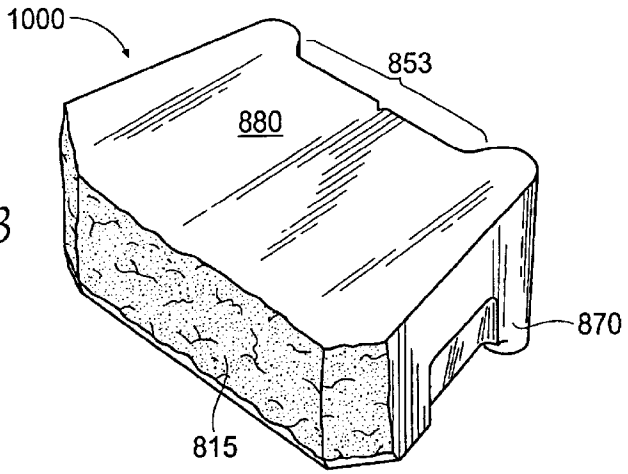
FIG. 43 is an elevated, front perspective view of the sixth embodiment of interlocking masonry wall block showing the generally trapezoidal shape of the upper surface.
Figure 45:
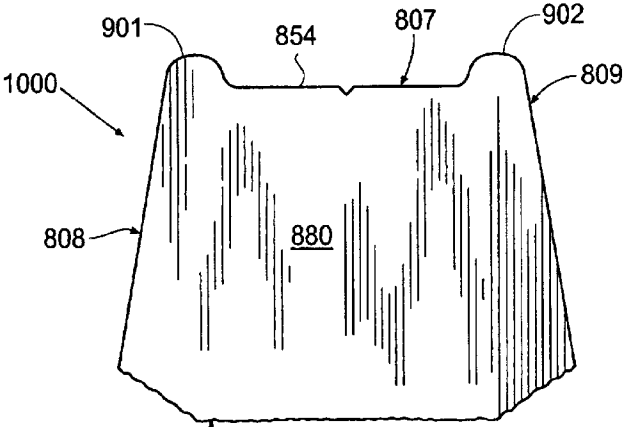
FIG. 45 is a top view of the sixth embodiment of the interlocking masonry wall block showing the groove dividing the block into symmetrical pieces.
Figure 48:
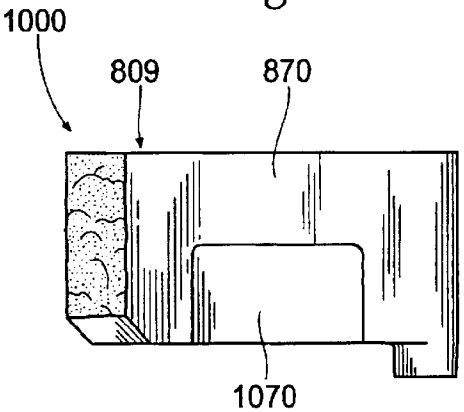
FIG. 48 is an end view of the sixth embodiment of the interlocking masonry wall block showing a lug with an arcuate wall.
Figure 47:
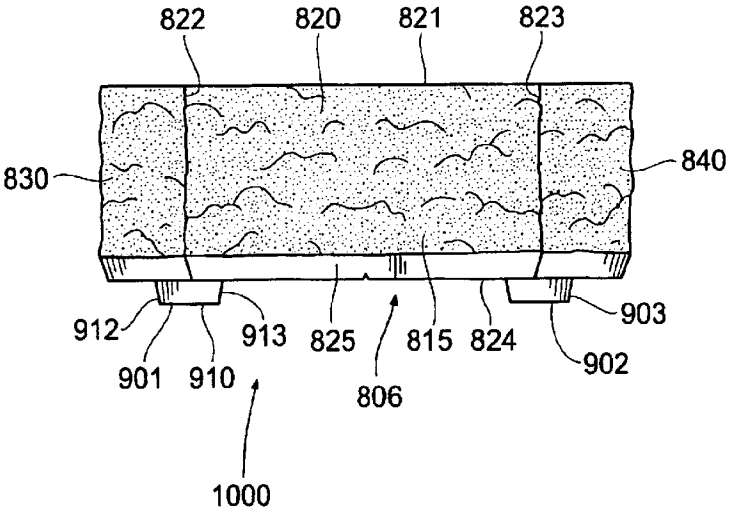
FIG. 47 is a front view of the sixth embodiment of the interlocking masonry wall blocks.
Figure 49:
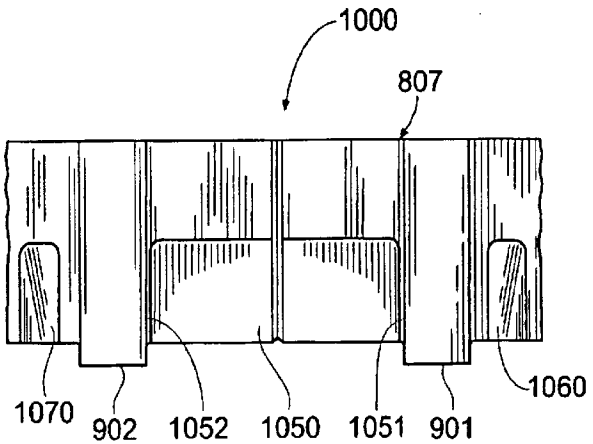
FIG. 49 is a rear view of the sixth embodiment of the interlocking masonry wall block showing the lugs and the splitting groove.

An upper course 951 of blocks 800 is placed on top of its immediately lower course 952. The lugs 901 and 902 of the blocks 800 in the upper course 951 are received by the recesses 853 of blocks in the immediately lower course 952. The lugs 901 and 902 are placed in abutting engagement with the recess wall 854. The lower surface 890 of the blocks 800 in the upper course 951 lay flushly against and in parallel alignment with the upper surface 880 of the blocks in the lower course 952. As best shown in FIG. 41, each block 800 in the upper course 951 is rearwardly offset ⅝ inch in relative to the blocks 800 upon which it lays in the immediately lower course 952.

The blocks 800 forming the upper course 951 are preferably horizontally staggered relative to the blocks forming its immediate lower course 952. Each block 800 in the upper course 951 is preferably laterally staggered about half the width of the block relative to the two blocks upon which it lays in the lower course 952. When placed in this staggered relationship, the recess 853 of a first lower block 800 in the lower course 952 receives the right lug 902 of an upper block in the upper course 951 and the left lug 901 of a second upper block in the upper course. The front most point 904 of the lugs of the upper blocks in the upper course 951 abuttingly engages the recess wall 854 of the first and second adjacent blocks in the lower course 852 upon which the upper block lays or rests. The block 800 in the upper course 951 is rearwardly set back from its two lower blocks a distance substantially equal to the setback dimension Sb of the block. This distance is equal to the setback dimension Sb for straight wall sections as shown in FIG. 41. This process is repeated for each block 800 in each upper course 951 until the desired wall height is achieved.

When building a serpentine wall, one of the lugs 901 or 902 of some of the block 800 can be removed to avoid discontinuities in the wall pattern and create a smooth serpentine wall 950. The ability to periodically remove one of the lugs can be particularly advantageous when building a wall with a tight radius curve. The structural integrity of the wall 950 should not be significantly affected by occasionally removing one of the lugs 901 or 902. As should be evident, this single type of like-shaped block 800 is used to construct a variety of retaining wall layouts or patterns. The end block 800 of a course can be split along grooves 856 and 896. One half of the block is positioned at an end of the lower course 952. The second half of the split block 800 is placed on the opposite end of the row to complete a staggered upper course 951.

As noted above, the distance between the foremost point 904 of the lugs 901 and 902 and the recess wall 854 defines the setback dimension Sb. In this regard, the distance between the forward most point 904 and the rearmost point 905 of the lug 901 and 902 does not control the setback.

The recess wall 854 has a continuous linear shape from one side 880 of the block to the other 870, particularly along its top end 855. The continuous linear shape of the recess wall 854 allows the block to receive one of the lugs 901 or 902 of a mating upper block 800 at any point along the recess wall between its ends 857 and 858. This linear shape of the recess wall 854 creates a degree of flexibility in lug alignment. This flexibility in lug alignment allows adjacent blocks of one course to pivot about their abutting pivot joints while allowing each of those blocks to abuttingly receive the lugs of two upper blocks to form a free flowing serpentine wall that fits into a natural landscape setting.

The effective thickness $L_{th}$ of a circular shaped lugs 901 and 902 remains constant even when the blocks are angularly aligned to form a curved wall. Although a point of the lug wall 903 other than the front most point 904 abuttingly engages the recess wall 854 of the lower block, the full diameter or thickness $L_{th}$ of the lug is available to absorb the load placed on the lug.

Although the block 800 has been shown and described to have a preferred geometric shape, it should be understood that certain aspects of this geometry can change without departing from the broad aspects of this embodiment. For example, the angles of the outer walls 830 and 840 of the multi-faceted front wall 815 can vary, or the facets can be eliminated so that the front wall 815 has a single planar surface from one outer end 833 to the other 843. Additionally, several grooves can be formed in the block 800 to allow smaller or larger portions of the block to be split off to form the end blocks of each course 951 and 952 to accommodate different amounts of stagger.

FIGS. 43–49 show a variation of the fifth interlocking masonry wall block 800, which is generally referred to by reference number 1000. The block 1000 is similar in shape, size and structure to block 800, except that block 1000 does not have a core 879 spanning from one side wall 860 to the other 870. The recess wall 854 of block 1000 has a beveled portion 1050 and each of the side walls 860 and 870 have a beveled portion 1060 and 1070. The bevel 1050 in the recess wall 854 spans most of the recess 853, and is about six (6) inches wide. The rear bevel 1050 forms a wedge shaped void that starts about half way down the recess wall 854 and tapers into the block 1000 to a depth of about a half (½) inch at its bottom end where it joins the lower surface 890 of the block. The bevel 1050 has ends 1051 and 1052 that are rounded to a radius of about three-quarter (¾) inch. Bevels 1060 and 1070 are formed into the side surfaces 860 and 871. Bevels 1060 and 1070 are about four (4) inches long and two (2) inches tall. Each side bevel 1060 and 1070 forms a wedge shaped void in the side wall of the block that starts about half way down the side 860 or 870 and tapers into the block 1000 to a depth of about a half (½) inch at its bottom end where it joins with the lower surface 890 of the block.

While the invention has been described with reference to several preferred embodiments, it will be understood by those skilled in the art that various changes may be made and equivalents may be substituted without departing from the broader aspects of the inventive block designs.

I claim:

1. An interlocking masonry wall block for use with complementary blocks to form a multi-tiered wall having at least one lower tier with first and second lower blocks, said interlocking masonry wall block comprising:

a block having upper and lower surfaces, front and rear ends and first and second sides, said upper and lower surfaces being substantially parallel, and said front end having a front wall;

first and second spaced apart lugs integrally formed at said rear end of said block, said first lug being proximal said first side, and said second lug being proximal said second side, said lugs extending downwardly from said lower surface of said block, each of said lugs having a forward setback portion and a rearward reinforcement portion, said setback forward portion having a forward facing setback wall, a recess formed in said rear end of said block between said spaced apart lugs, said recess forming a rearward facing recess wall, said recess wall being substantially parallel to said front wall, said setback portions of said lugs being forward of said recess wall and said rearward reinforcement portions of said lugs being rearward of said recess wall, said recess wall and said setback wall being spaced apart a predetermined setback dimension, and, wherein said block is adapted to stack atop the first and second lower blocks in a staggered relation, said setback wall of said first lug of said block being adapted to abuttingly engage the recess wall of the first lower block, and said setback wall of said second lug of said block being adapted to abuttingly engage the recess wall of the second lower block, said front wall of said block being set back from the front wall of each of the lower blocks a distance substantially equal to said setback dimension.

2. The interlocking masonry wall block of claim 1, and wherein said reinforcement portion of each of said first and second lugs has an outside wall portion, and wherein said staggered relation positions said setback wall of one of either said first and second lugs of said block in abutting engagement with the sideward facing wall of one of the lugs of the lower blocks to inhibit sideways movement of said block.

3. The interlocking masonry wall block of claim 1, and wherein said setback wall of each said lug has a forward point located most forward said recess wall, and said forward points of said lugs define a setback line, and said setback dimension is a distance between said setback line (N and said recess wall.

4. The interlocking masonry wall block of claim 3, and wherein said setback line is substantially parallel to said recess wall.

5. The interlocking masonry wall block of claim 3, and wherein said lug has a circular shape.

6. The interlocking masonry wall block of claim 2, and wherein said front wall is a faceted front wall formed by a central wall and first and second outer walls, said central wall having opposed ends and each of said outer walls having inner and outer ends, each of said inner ends joining with one of said opposed ends to form a separate facet in said front wall, each of said outer walls being angling toward said rear end, and said recess wall being substantially parallel to said central wall.

7. The interlocking masonry wall block of claim 6, and wherein said first side has a first side wall and said second side has a second side wall, each of said side walls having forward and rearward ends, said forward end of said first side wall joining with said outer end of said front wall to form a first pivot joint, and said forward end of said second side wall joining with said outer end of said front wall to form a second pivot joint, said pivot joints forming a line that is substantially parallel to said front and recess walls, and wherein said block is adapted to abuttingly engage horizontally adjacent blocks at said pivot joints.

8. The interlocking masonry wall block of claim 7, and wherein said side walls converge as they extend from said forward end toward said rearward end, and said block has its largest width dimension between said pivot joints.

9. The interlocking masonry wall block of claim 8, and wherein each of said lugs have an outer wall, and said outer wall of said first lug flushly joins said first side wall, and said outer wall of said second lug flushly joins said second side wall.

10. The interlocking masonry wall block of claim 1, and wherein said front wall, side walls, lug walls and recess wall are substantially perpendicular to said upper and lower surfaces.

* * * * *

UNITED STATES PATENT AND TRADEMARK OFFICE

CERTIFICATE OF CORRECTION

PATENT NO. : 6,871,468 B2
DATED : March 29, 2005
INVENTOR(S) : Robert L. Whitson It is certified that error appears in the above-identified patent and that said Letters Patent is hereby corrected as shown below:

Title page,
Item [56], References Cited, U.S. PATENT DOCUMENTS, insert -- 6,142,713, issued 11/07/2000 to Woolford et al. --.

Column 23,
Line 5, after "line" delete "(N" and substitute -- , -- (comma).

Signed and Sealed this

Eighth Day of November, 2005

JON W. DUDAS
*Director of the United States Patent and Trademark Office*